US011339013B2

(12) United States Patent
Shuto et al.

(10) Patent No.: US 11,339,013 B2
(45) Date of Patent: May 24, 2022

(54) MEDIUM FEEDING APPARATUS

(71) Applicant: SEIKO EPSON CORPORATION, Tokyo (JP)

(72) Inventors: Ryoichi Shuto, Kitakyushu (JP); Kazuhito Noda, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/935,516

(22) Filed: Jul. 22, 2020

(65) Prior Publication Data

US 2021/0024306 A1 Jan. 28, 2021

(30) Foreign Application Priority Data

Jul. 25, 2019 (JP) ..... JP2019-137145

(51) Int. Cl.
*B65H 1/04* (2006.01)

(52) U.S. Cl.
CPC ..... *B65H 1/04* (2013.01); *B65H 2405/114* (2013.01); *B65H 2511/12* (2013.01)

(58) Field of Classification Search
CPC . B65H 1/04; B65H 1/26; B65H 1/266; B65H 9/101; B65H 2405/114; B65H 2405/1144; B65H 2405/1142; B65H 2405/11425; B65H 2511/12; B65H 2402/10; B65H 2701/1914; B65H 2601/321
See application file for complete search history.

(56) References Cited

U.S. PATENT DOCUMENTS 7,967,287 B2 * 6/2011 Hamasaki ..... B65H 1/266 271/171
9,694,998 B2 * 7/2017 Lee ..... B65H 7/10
2007/0120316 A1 * 5/2007 Shiohara ..... B65H 1/266 271/145

FOREIGN PATENT DOCUMENTS

JP 2017-165575 A 9/2017

* cited by examiner

*Primary Examiner* — Prasad V Gokhale
(74) *Attorney, Agent, or Firm* — Workman Nydegger

(57) ABSTRACT

A medium feeding apparatus includes a medium mounting section, a movable edge guide that guides both edges of the medium mounted on the medium mounting section and has a first edge guide and a second edge guide, a feeding section, and a width adjuster configured to adjust a guide width depending on the medium. The width adjuster includes a first adjuster having a first holding section and a first guiding section, and the second adjuster having a second holding section and a second guiding section. The first holding section holds a part of the first edge guide, the first guiding section guides the edge of the medium between the first edge guide and the second guiding section, the second holding section holds a part of the second edge guide, and the second guiding section guides the edge of the medium between the second edge guide and the first guiding section.

7 Claims, 16 Drawing Sheets

MEDIUM FEEDING APPARATUS

The present application is based on, and claims priority from JP Application Serial Number 2019-137145, filed Jul. 25, 2019, the disclosure of which is hereby incorporated by reference herein in its entirety.

BACKGROUND

1. Technical Field

The present disclosure relates to a medium feeding apparatus.

2. Related Art

Sheet feeding apparatuses (medium feeding apparatuses) that transport a paper sheet (medium) with less change in the transport direction, or skew have been proposed, for example, in JP-A-2017-165575. The medium feeding apparatus described in JP-A-2017-165575 includes side guides and upper guides that are attached to the side guides on an upstream part in a medium transport direction, and the side guides and the upper guides are attached to a tray on which a medium is mounted. The side guides can be slid in a medium width direction, and are adjusted depending on the size of a medium, regulating the position of the medium in the width direction so as not to cause skew. The upper guides regulate the positions of upstream-left and upstream-right edges of a medium mounted on the tray.

In the medium feeding apparatus described in JP-A-2017-165575, the side guides are moved depending on the size of a commonly used medium to suppress skew of the commonly used medium. The side guides are, however, insufficient to guide a special size medium that is narrower in width than the commonly used medium, and thus the medium feeding apparatus described in JP-A-2017-165575 is insufficient to suppress skew of special size media.

SUMMARY

A medium feeding apparatus includes a medium mounting section on which a medium is to be mounted, a movable edge guide configured to guide both edges of the medium mounted on the medium mounting section, the edge guide having a first edge guide and a second edge guide, a feeding section configured to feed the medium mounted on the medium mounting section, a width adjuster detachably attached to the edge guide, the width adjuster being configured to adjust a guide width depending on the medium. The width adjuster comprises a first adjuster having a first holding section and a first guiding section, and the second adjuster having a second holding section and a second guiding section, the first holding section holds a part of the first edge guide, the first guiding section guides the edge of the medium between the first edge guide and the second guiding section, the second holding section holds a part of the second edge guide, and the second guiding section guides the edge of the medium between the second edge guide and the first guiding section.

In the medium feeding apparatus, the medium mounting section may include a rotation member configured to facilitate the feeding of the medium, and the width adjuster may have a hole for exposing the rotation member when the width adjuster is attached to the edge guide.

In the medium feeding apparatus, the first adjuster and the second adjuster may be separate components.

In the medium feeding apparatus, the first guiding section may extend downstream longer in the sheet feeding direction than the first edge guide, and the second guiding section may extend downstream longer in the sheet feeding direction than the second edge guide.

A medium feeding apparatus includes a medium mounting section on which a medium is to be mounted, a movable edge guide configured to guide both edges of the medium mounted on the medium mounting section, the edge guide having a first edge guide and a second edge guide, a feeding section configured to feed the medium mounted on the medium mounting section, a width adjuster detachably attached to the medium mounting section, the width adjuster being configured to adjust a guide width depending on the medium. The width adjuster includes an engaging portion to be engaged with an engaged portion of the medium mounting section, a first guiding section configured to guide the edge of the medium at a position closer to a central portion in the medium mounting section than the first edge guide, and a second guiding section configured to guide the edge of the medium at a position closer to the central portion in the medium mounting section than the second edge guide.

In the medium feeding apparatus, the engaged portion may be a concave portion or a hole in the mounting surface of the medium mounting section.

In the medium feeding apparatus, the medium mounting section may further include a rotation member configured to facilitate the feeding of the medium, and the width adjuster may have a hole for exposing the rotation member when the width adjuster is attached to the medium mounting section.

A medium feeding apparatus includes a body, a medium mounting section on which a medium is to be mounted, a movable edge guide configured to guide both edges of the medium mounted on the medium mounting section, the edge guide having a first edge guide and a second edge guide, a feeding section configured to feed the medium mounted on the medium mounting section, and a width adjuster detachably attached to at least one of the body section, the medium mounting section, and the edge guide, the width adjuster being configured to adjust a guide width depending on the medium. The width adjuster includes a fixing section to be attached to at least one of the body section, the medium mounting section, and the edge guide, a first guiding section configured to guide the edge of the medium, and a second guiding section configured to guide the edge of the medium, and a minimum width for guiding the medium with the first guiding section and the second guiding section is narrower than a minimum width for guiding the medium with the first edge guide and the second edge guide.

In the medium feeding apparatus, at least one of the first guiding section and the second guiding section may be configured to move in the same direction as the first edge guide or the second edge guide.

In the medium feeding apparatus, the width adjuster may have at least one feed slot from which the medium is fed.

DESCRIPTION OF EXEMPLARY EMBODIMENTS

1. First Embodiment

Figure 1:
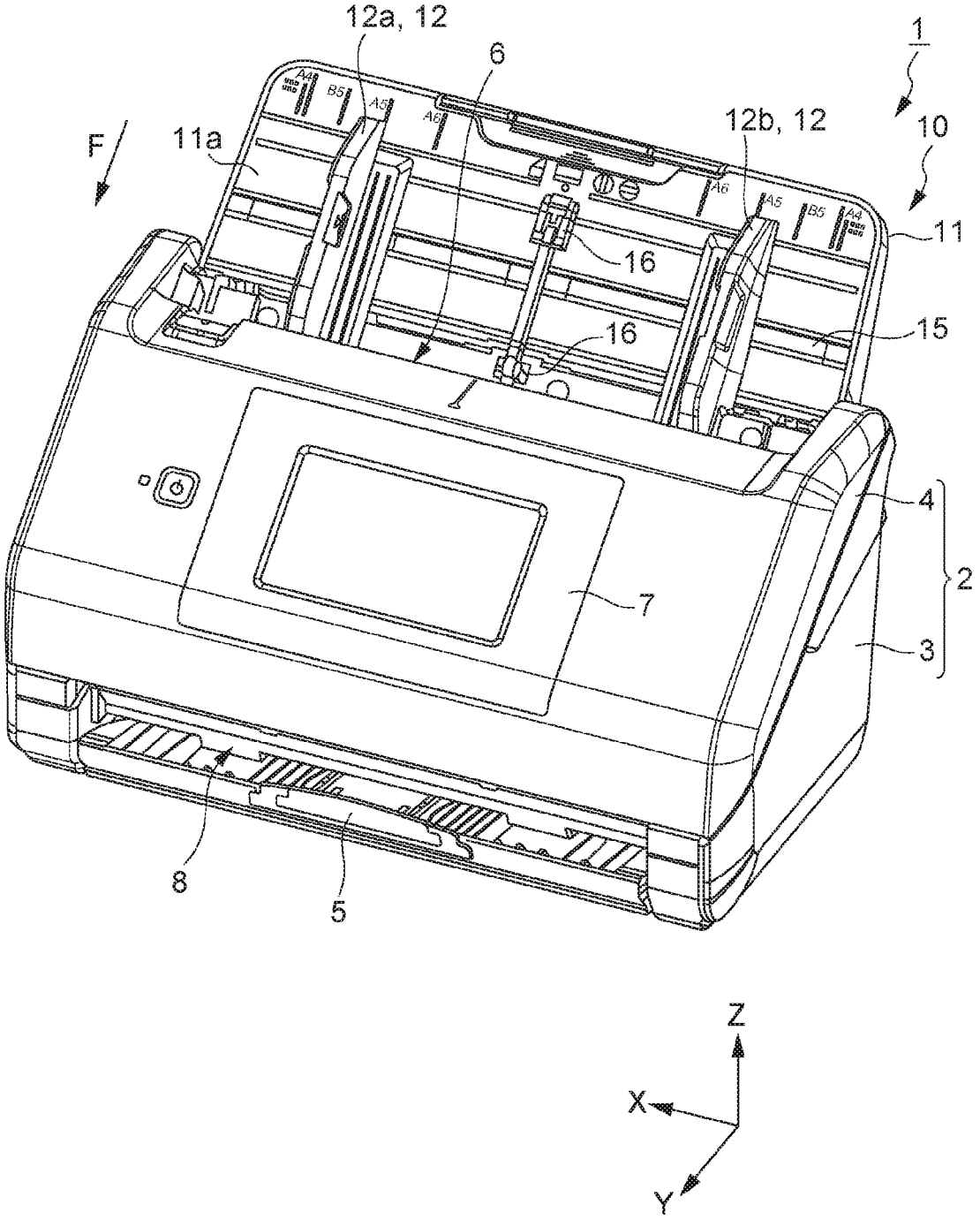
FIG. 1 is a perspective view schematically illustrating a scanner.
Figure 2:
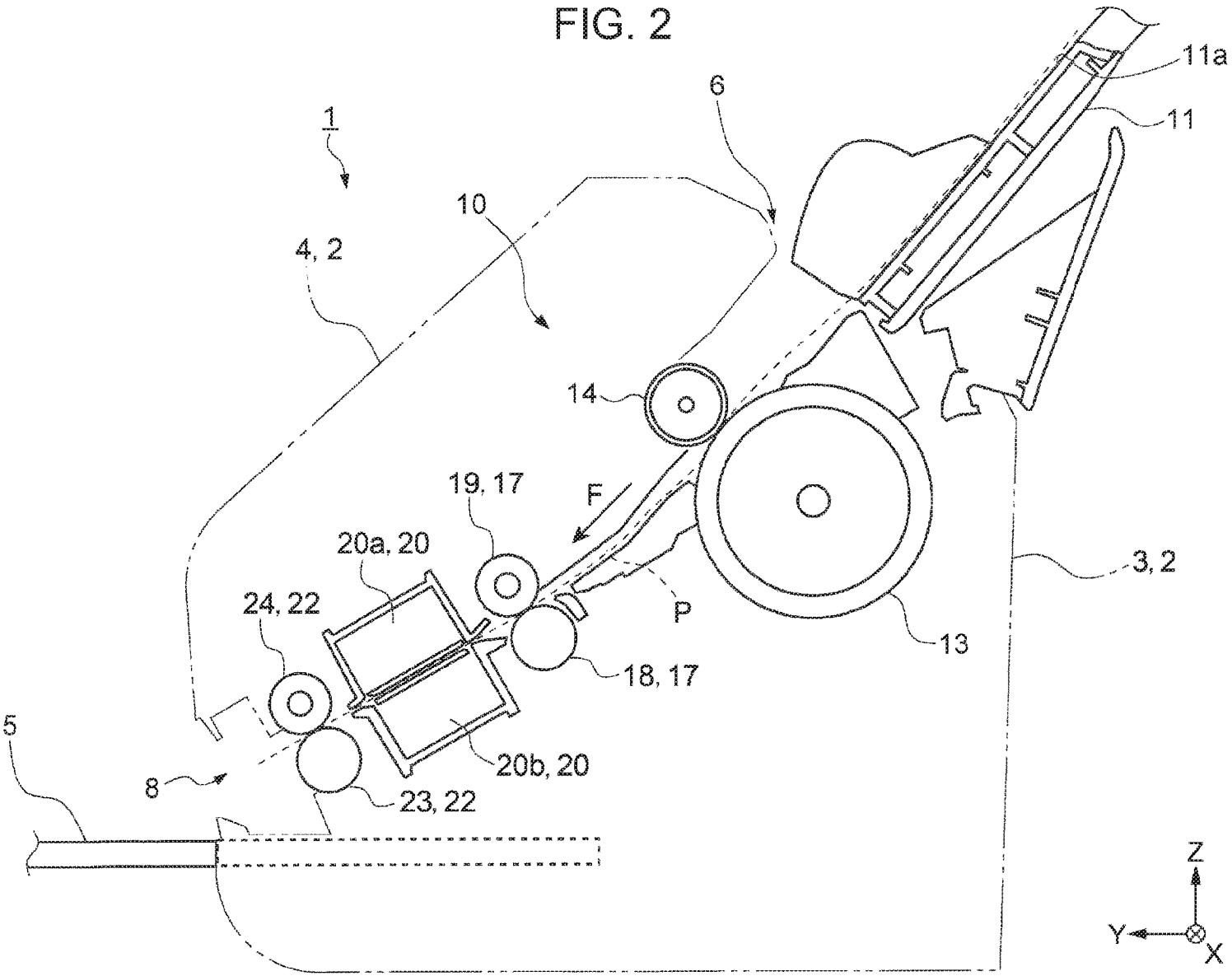
FIG. 2 is a side cross-sectional view of a scanner.
Figure 3:
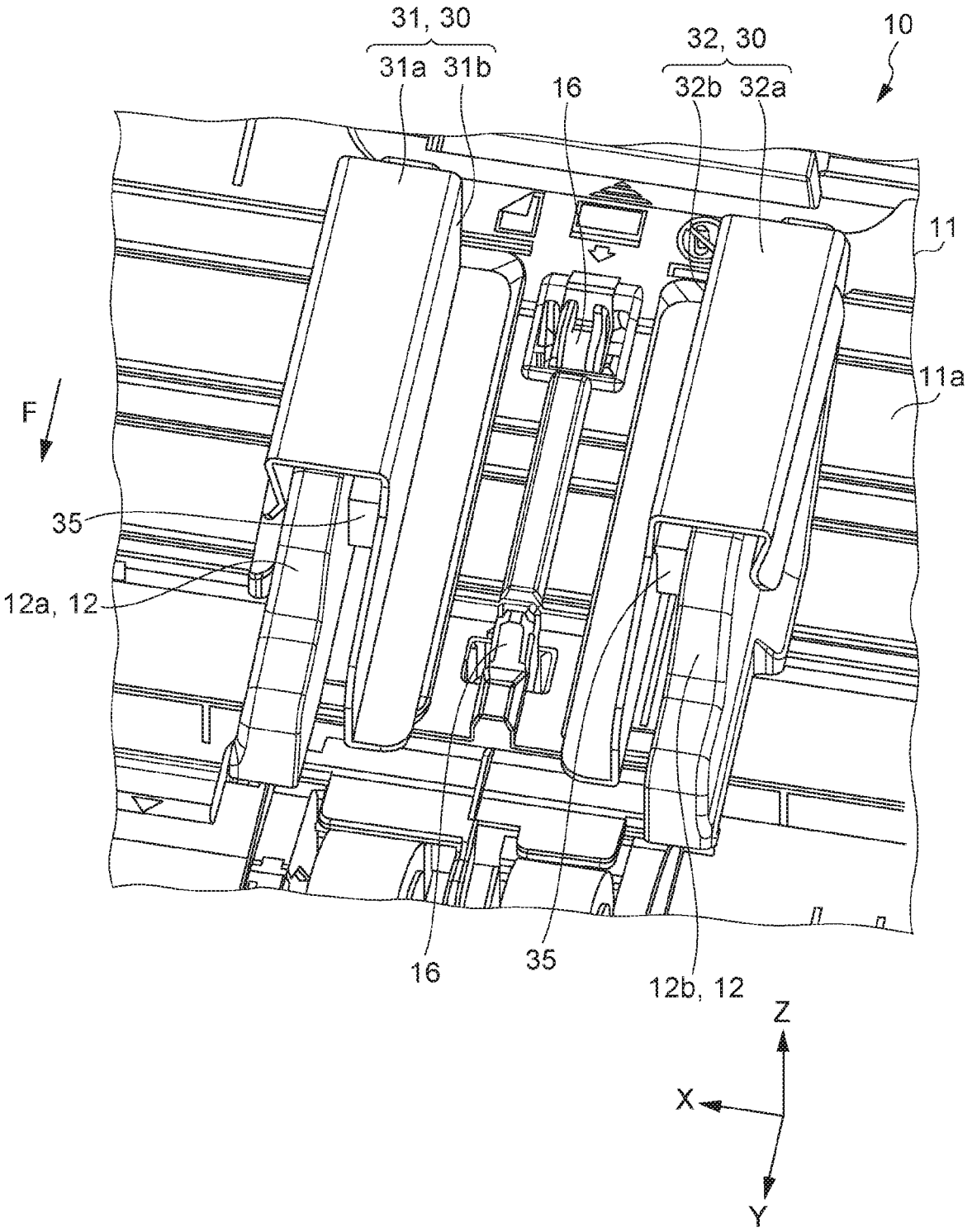
FIG. 3 is a perspective view illustrating a part to which a width adjuster of a medium feeding apparatus according to a first embodiment is attached.
Figure 4:
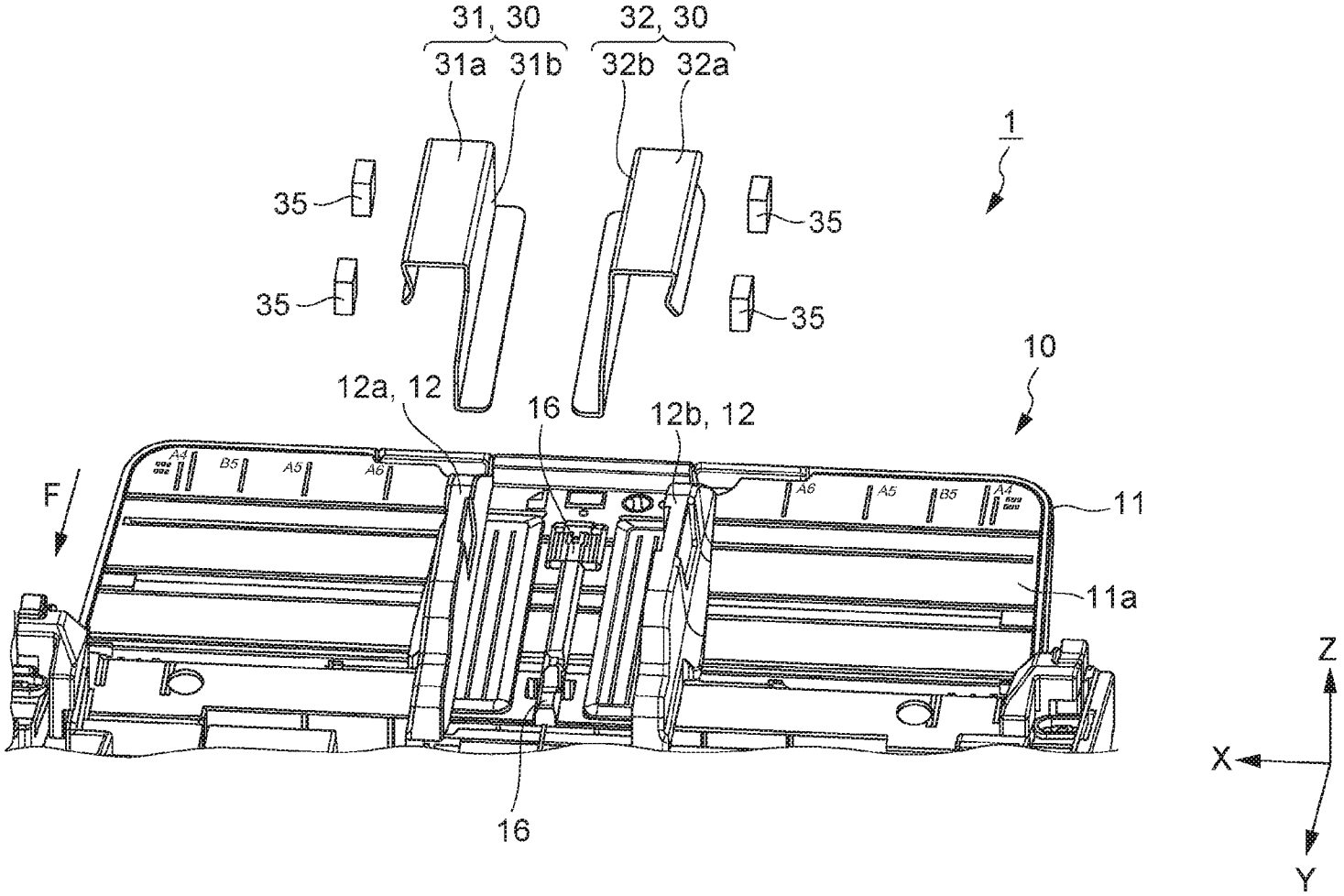
FIG. 4 is an exploded perspective view illustrating a part to which a width adjuster of a medium feeding apparatus according to the first embodiment is attached.
Figure 5:
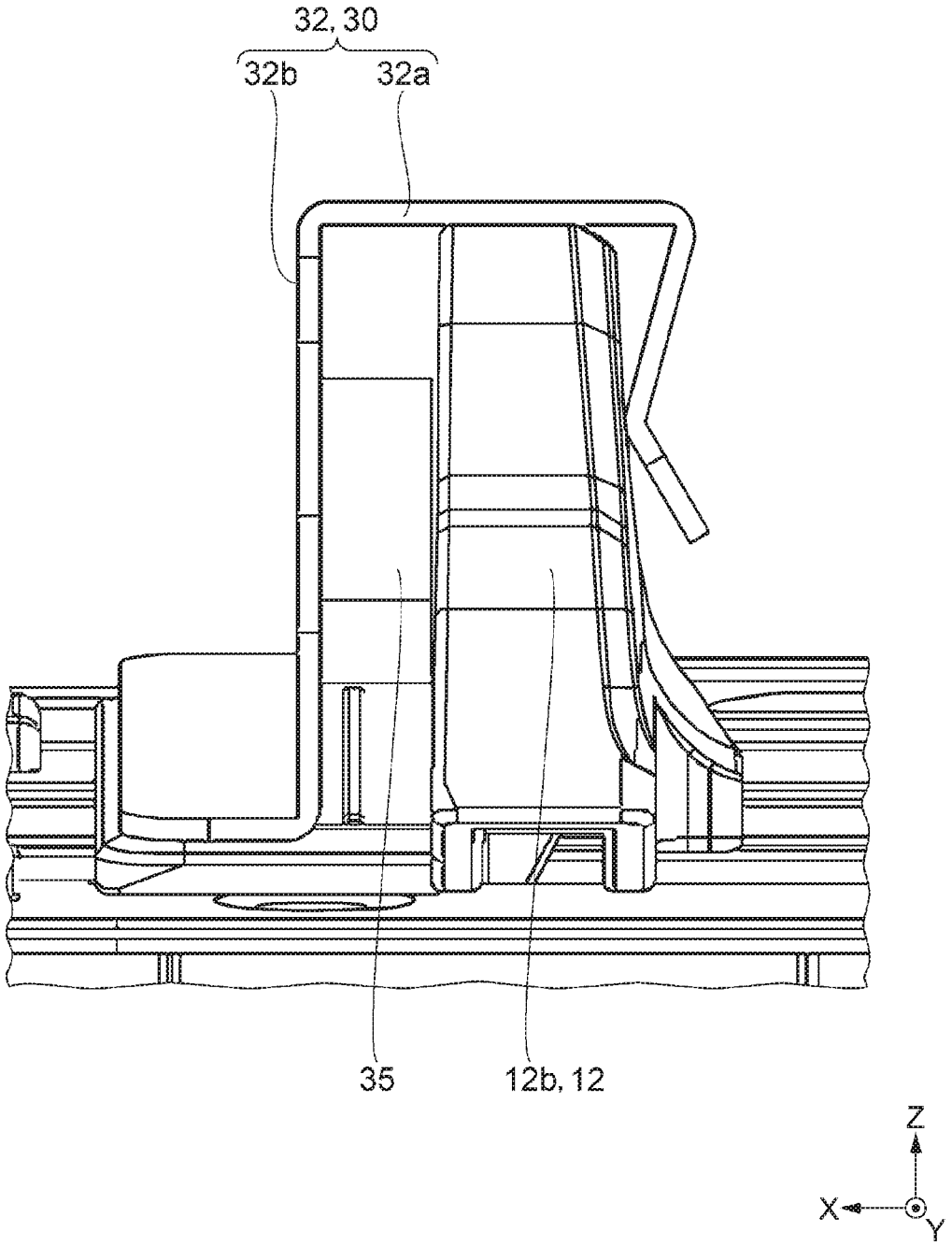
FIG. 5 illustrates a part to which a width adjuster is attached, the part viewed from a sheet feeding direction F.

FIG. 1 is a perspective view schematically illustrating a scanner 1. FIG. 2 is a side cross-sectional view of the scanner 1 in which a sheet feeding path for a medium P is illustrated by a broken line. FIG. 3 is a perspective view illustrating a part to which a width adjuster 30 of a medium feeding apparatus 10 according to the first embodiment is attached. FIG. 4 is an exploded perspective view illustrating a part to which the width adjuster 30 of the medium feeding apparatus 10 according to the embodiment is attached. FIG. 5 illustrates a part to which the width adjuster 30 is attached, the part viewed from a sheet feeding direction F. In FIG. 1 and FIG. 2, the width adjuster 30 is not attached to an edge guide 12, and in FIG. 3 to FIG. 5, the width adjuster 30 is attached to the edge guide 12.

As illustrated in FIG. 1, the scanner 1 is an image reading apparatus that can read at least one side of a front side and a back side of a medium P, and includes an apparatus body 2 and a reading section 20 (see FIG. 2) that reads an image on a medium P that is provided in the apparatus body 2. The apparatus body 2 serves as an outer case of the medium feeding apparatus 10 according to the embodiment, and is an example body section according to the embodiment of the present disclosure. The medium feeding apparatus 10 according to the embodiment includes the apparatus body 2, and feeds a medium P toward the reading section 20. In the description below, a width direction of the scanner 1 is an X direction, a depth direction of the scanner 1 is a Y direction, a height direction of the scanner 1 is a Z direction, and a direction in which a medium P is fed (transported) is the sheet feeding direction F. A tip side of an arrow that indicates a direction is a +direction, and a base end side of the arrow that indicates the direction is a −direction. The X direction is a direction orthogonal to the sheet feeding direction F and is a width direction of a medium P.

The apparatus body 2 includes a lower unit 3 and an upper unit 4. The upper unit 4 is attached to the lower unit 3 openably and closably about a downstream part in the direction in which a medium P is transported. A user turns the upper unit 4 toward an apparatus front side to open the upper unit 4 so as to expose a medium transport path of a medium P to facilitate fixing of a paper jam of medium P. An operation panel 7 is provided on the apparatus front side of the upper unit 4. The operation panel 7 is used to set various settings for reading, execute a reading operation, display reading setting contents, or the like. In an upper part of the upper unit 4, a medium feed slot 6 that is a slot to the inside of the apparatus body 2 is provided. On the apparatus front side of the lower unit 3, a discharge slot 8 from which a medium P is discharged and a discharge tray 5 on which the discharged medium P is mounted are provided.

The medium feeding apparatus 10 includes a medium mounting section 11 and the edge guide 12. The medium mounting section 11 has a mounting surface 11*a* on which a medium P is mounted. The edge guide 12 guides both edges of a medium P that is mounted on the medium mounting section 11. The medium feed slot 6 is a slot for a medium P defined by the edge guide 12 (a first edge guide 12*a* and a second edge guide 12*b*).

The edge guide 12 includes the first edge guide 12*a* that is disposed on the +X-direction side and the second edge guide 12*b* that is disposed on the −X-direction side. The first edge guide 12*a* and the second edge guide 12*b* can be moved in the X direction in accordance with the size of a medium P. More specifically, the medium feeding apparatus 10 includes the movable edge guide 12 that guides both edges of a medium P that is mounted on the medium mounting section 11 and has the first edge guide 12*a* and the second edge guide 12*b*. A guide width (size in the X direction) of a medium P that can be guided with the first edge guide 12*a* and the second edge guide 12*b* ranges approximately from 50 mm to 210 mm (A4 size).

The medium mounting section 11 has a slit 15 that extends in the width direction (X direction) of a medium P. The slit 15 is a through hole in the mounting surface 11*a*. The first edge guide 12*a* and the second edge guide 12*b* are fit into the slit 15. The first edge guide 12*a* and the second edge guide 12*b* are configured such that by a known rack-and-pinion mechanism (not illustrated), following a movement of one edge guide 12 (for example, the first edge guide 12*a*) in the X direction, the other edge guide 12 (the second edge guide 12*b*) moves in the opposite direction. Portions of the first edge guide 12*a* and the second edge guide 12*b* on the +Z direction side with respect to the slit 15 are portions for guiding both edges of a medium P. Portions of the first edge guide 12*a* and the second edge guide 12*b* on the −Z direction side with respect to the slit 15 are portions supported by the rack-and-pinion mechanism. The slit 15 that extends in the X direction in the medium mounting section 11 allows the edge guide 12 to move stably in the X direction.

The medium mounting section 11 also includes two rotation members 16 that allow a medium P to be fed smoothly in the medium mounting section 11. The two rotation members 16 are located at a central part of the medium mounting section 11 in the width direction (X direction), and are rotatably attached to the mounting surface 11*a*. One of the rotation members 16 is disposed upstream in the sheet feeding direction F and the other rotation member 16 is disposed downstream in the sheet feeding direction F.

In the medium feeding apparatus 10, a medium P is aligned with the center in the width direction on the medium mounting section 11 by using the edge guide 12. More specifically, in the medium feeding apparatus 10, the medium P is fed in the sheet feeding direction F by so-called center paper feeding. Furthermore, the medium P mounted on the medium mounting section 11 is smoothly fed in the sheet feeding direction F with the rotation members 16. The medium feeding apparatus 10 may be a one-side-feeding medium feeding apparatus that includes one edge guide 12 that is fixed to the medium mounting section 11 and the other edge guide 12 that can be moved with respect to the medium mounting section 11.

As illustrated in FIG. 2, the medium feed slot 6, a feeding roller 13 and a separation roller 14, a transport roller pair 17, the reading section 20 for reading images, and a discharging roller pair 22 are disposed in this order along the sheet feeding direction F in which a medium P is to be fed. The feeding roller 13 and the separation roller 14, the transport roller pair 17, and the discharging roller pair 22 are components of the medium feeding apparatus 10. The reading section 20 for reading images is a component of the scanner 1. The feeding roller 13 and the separation roller 14, and the transport roller pair 17 are an example feeding section according to the embodiment.

A medium P mounted on the medium mounting section 11 is picked by the feeding roller 13, which is rotatably disposed in the lower unit 3, and fed in the sheet feeding direction F. More specifically, the feeding roller 13 rotates while coming into contact with a back surface (a surface that faces the mounting surface 11*a*) of the medium P and thereby the medium P is fed in the sheet feeding direction F. With this structure, from a plurality of sheets of medium P mounted on the medium mounting section 11, the medium P on the side of the mounting surface 11*a* of the medium mounting section 11 are sequentially fed in the sheet feeding direction F. The separation roller 14 is provided to prevent the sheets of medium P from being fed in an overlapped state. The plurality of sheets of medium P mounted on the medium mounting section 11 are nipped by the feeding roller 13 and the separation roller 14 one by one and fed in the sheet feeding direction F.

The medium P nipped by the feeding roller 13 and the separation roller 14 and fed downstream in the sheet feeding direction F is nipped by the transport roller pair 17 and transported to the reading section 20 that is disposed on the downstream part of the transport roller pair 17 in the sheet feeding direction F. The transport roller pair 17 includes a transport driving roller 18 that is disposed in the lower unit 3 and a transport driven roller 19 that is disposed in the upper unit 4 to rotate following the transport driving roller 18.

The reading section 20 includes an upper image reading sensor 20*a* that is provided on the side of the upper unit 4 and a lower image reading sensor 20*b* that is provided on the side of the lower unit 3. The upper image reading sensor 20*a* and the lower image reading sensor 20*b* each comprise, for example, a contact image sensor (CIS) module (CISM).

After an image on at least one of the front side and the back side of the medium P has been read by the reading section 20, the medium P is nipped by the discharging roller pair 22 that is disposed on the downstream part of the reading section 20 in the sheet feeding direction F and discharged from the discharge slot 8 that is provided on the apparatus front side of the lower unit 3. The discharging roller pair 22 includes a discharge driving roller 23 that is disposed in the lower unit 3 and a discharge driven roller 24 that is disposed in the upper unit 4 to rotate following the discharge driving roller 23. The lower unit 3 includes the discharge tray 5 that can be extended from the discharge slot 8 toward the apparatus front side. In the state the discharge tray 5 is extended, the medium P that is discharged from the discharge slot 8 is stacked on the discharge tray 5.

As described above, the first edge guide 12*a* and the second edge guide 12*b* can guide a medium P of a width within about 50 mm to 210 mm, and thus when the scanner 1 is in the state illustrated in FIG. 1, a minimum guide width of a medium P that can be guided by the edge guide 12 is 50 mm. When a medium P with a width narrower than 50 mm (hereinafter, referred to as a special size medium P) such as a sales slip or a business card is mounted for image reading, the special size medium P is mounted between the pair of edge guides 12*a* and 12*b* and away from the pair of edge guides 12*a* and 12*b*. Accordingly, depending on the state of the special size medium P mounted on the medium mounting section 11, the special size medium P may not be fed in the sheet feeding direction F and may be fed in a direction intersecting the sheet feeding direction F, resulting in skew of the special size medium P. Then, the scanner 1 in the state illustrated in FIG. 1 will improperly read the image on the special size medium P.

In this embodiment, in reading an image on a special size medium P by the scanner 1, that is, in feeding a special size medium P in the sheet feeding direction F by the medium feeding apparatus 10, the width adjuster 30 is attached to the edge guide 12. As illustrated in FIG. 3, the medium feeding apparatus 10 according to the embodiment is provided with the width adjuster 30 that is detachably attached to the edge guide 12 to adjust the guide width depending on a special size medium P. The width adjuster 30 comprises a first adjuster 31 that is detachably attached to the first edge guide 12*a* and a second adjuster 32 that is detachably attached to the second edge guide 12*b*. In the width adjuster 30, the first adjuster 31 and the second adjuster 32 are separate components. As described above, in feeding a special size medium P in the sheet feeding direction F by the medium feeding apparatus 10, the width adjuster 30 that comprises the first adjuster 31 and the second adjuster 32 is attached to the edge guide 12.

As illustrated in FIG. 3 and FIG. 4, the first adjuster 31 has a first holding section 31*a* and a first guiding section 31*b*, and the second adjuster 32 has a second holding section 32*a* and a second guiding section 32*b*. The first holding section 31*a* is a section for holding the first edge guide 12*a* in the first adjuster 31 when the first adjuster 31 is attached to the first edge guide 12*a*. The first guiding section 31*b* is a section for guiding an edge of a medium P in the first adjuster 31 that is attached to the first edge guide 12*a* when the medium P mounted on the medium mounting section 11 is fed in the sheet feeding direction F. The second holding section 32*a* is a section for holding the second edge guide 12*b* in the second adjuster 32 when the second adjuster 32 is attached to the second edge guide 12*b*. The second guiding section 32*b* is a section for guiding an edge of a medium P in the second adjuster 32 that is attached to the second edge guide 12*b* when the medium P mounted on the medium mounting section 11 is fed in the sheet feeding direction F.

The first holding section 31*a* holds a part of the first edge guide 12*a*. More specifically, the first holding section 31*a* holds a part of the first edge guide 12*a* with an elastic member 35 being disposed between the first edge guide 12*a*. The elastic member 35 is disposed in a compressed state between the first holding section 31*a* and the first edge guide 12*a* to apply a force from the elastic member 35 to press the first holding section 31*a* against the first edge guide 12*a* to fix the first holding section 31*a* to the first edge guide 12*a*. The second holding section 32*a* holds a part of the second edge guide 12*b*. More specifically, the second holding section 32*a* holds a part of the second edge guide 12*b* with the elastic member 35 being disposed between the second edge guide 12*b*. The elastic member 35 is disposed in a compressed state between the second holding section 32*a* and the second edge guide 12*b* to apply a force from the elastic member 35 to press the second holding section 32*a* against the second edge guide 12*b* to fix the second holding section 32*a* to the second edge guide 12*b*.

The elastic member 35 is an elastic rubber. The elastic member 35 may be, instead of the elastic rubber, springs such as a leaf spring. The width adjuster 30 may be an elastic member without the elastic member 35. The width adjuster 30 that has elasticity may be directly attached to the edge guide 12 without the elastic member 35.

The first adjuster 31 is attached to the first edge guide 12*a* by a user with the elastic member 35 being disposed inside the first holding section 31*a* by pressing the first adjuster 31 in the −Z direction such that the first holding section 31*a* holds a part of the first edge guide 12*a*. The first adjuster 31 is detached from the first edge guide 12*a* by a user by pulling the first adjuster 31 that is being attached to the first edge guide 12*a* in the +Z direction. Similarly, the second adjuster 32 is attached to the second edge guide 12*b* by a user with the elastic member 35 being disposed inside the second holding section 32*a* by pressing the second adjuster 32 in the −Z direction such that the second holding section 32*a* holds a part of the second edge guide 12*b*. The second adjuster 32 is detached from the second edge guide 12*b* by a user by pulling the second adjuster 32 that is being attached to the second edge guide 12*b* in the +Z direction. As described above, the width adjuster 30 can be attached to or detached from the edge guide 12 by simply pressing the first adjuster 31 and the second adjuster 32 in the −Z direction or by simply pulling the first adjuster 31 and the second adjuster 32 in the +Z direction.

The first edge guide 12*a*, the first guiding section 31*b*, the second guiding section 32*b*, and the second edge guide 12*b* are disposed in this order along the width direction (−X direction) of a medium P. The first guiding section 31*b* and the second guiding section 32*b* are disposed between the first edge guide 12*a* and the second edge guide 12*b*. The first guiding section 31*b* guides an edge of a medium P between the first edge guide 12*a* and the second guiding section 32*b*, and the second guiding section 32*b* guides an edge of the medium P between the second edge guide 12*b* and the first 31*b*. With this structure, as compared with a structure in which a medium P is guided by a pair of edge guides 12*a* and 12*b*, the guide width of the medium P guided by a pair of guiding sections 31*b* and 32*b* (a pair of adjusters 31 and 32) is narrow, and thus a pair of adjusters 31 and 32 can guide a medium P of a special size.

Accordingly, when a pair of adjusters 31 and 32 is attached to a pair of edge guides 12*a* and 12*b*, that is, when the width adjuster 30 is attached to the edge guide 12, a special size medium P is fed in the sheet feeding direction F while being guided by the width adjuster 30, and thus problems such as skew of the special size medium P produced when the special size medium P is fed without being guided by the edge guide 12 can be suppressed, and the medium feeding apparatus 10 can properly feed the special size medium P mounted on the medium mounting section 11 in the sheet feeding direction F and the scanner 1 can properly read an image on the special size medium P. In this embodiment, the above-described width adjuster 30 can guide a special size medium P having a width of about 44 mm.

The guide widths of special size media P are not limited to about 44 mm, and when special size media P that have various sizes are used, various width adjusters that correspond to the special size media P that have various sizes may be provided respectively. With the various width adjusters attached to the edge guide 12, the medium feeding apparatus 10 can properly feed the special size media P of various sizes in the sheet feeding direction F respectively, and the scanner 1 can properly read respective images on the various special size media P.

2. Second Embodiment

Figure 6:
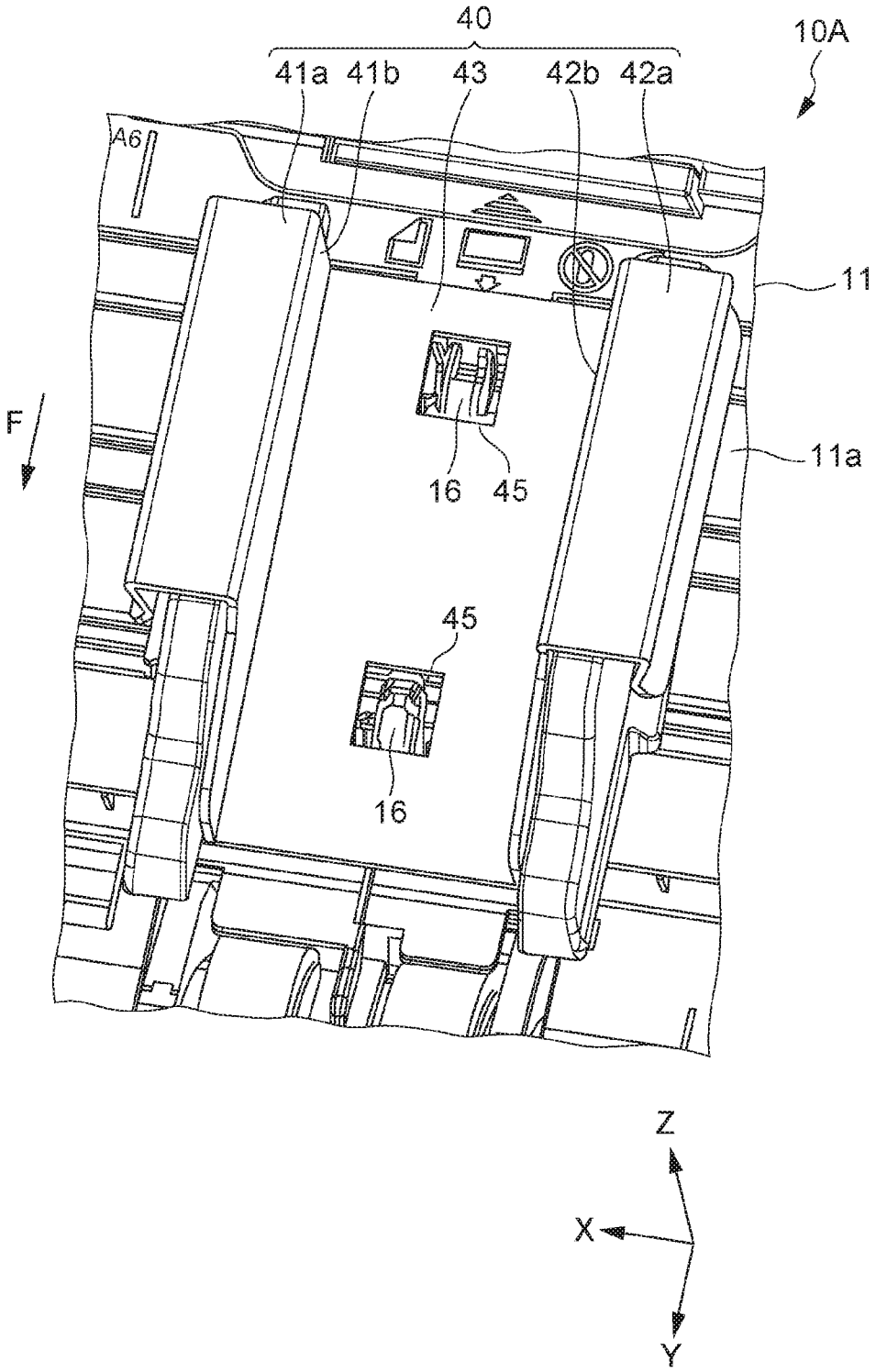
FIG. 6 is a perspective view illustrating a part to which a width adjuster of a medium feeding apparatus according to a second embodiment is attached.
Figure 7:
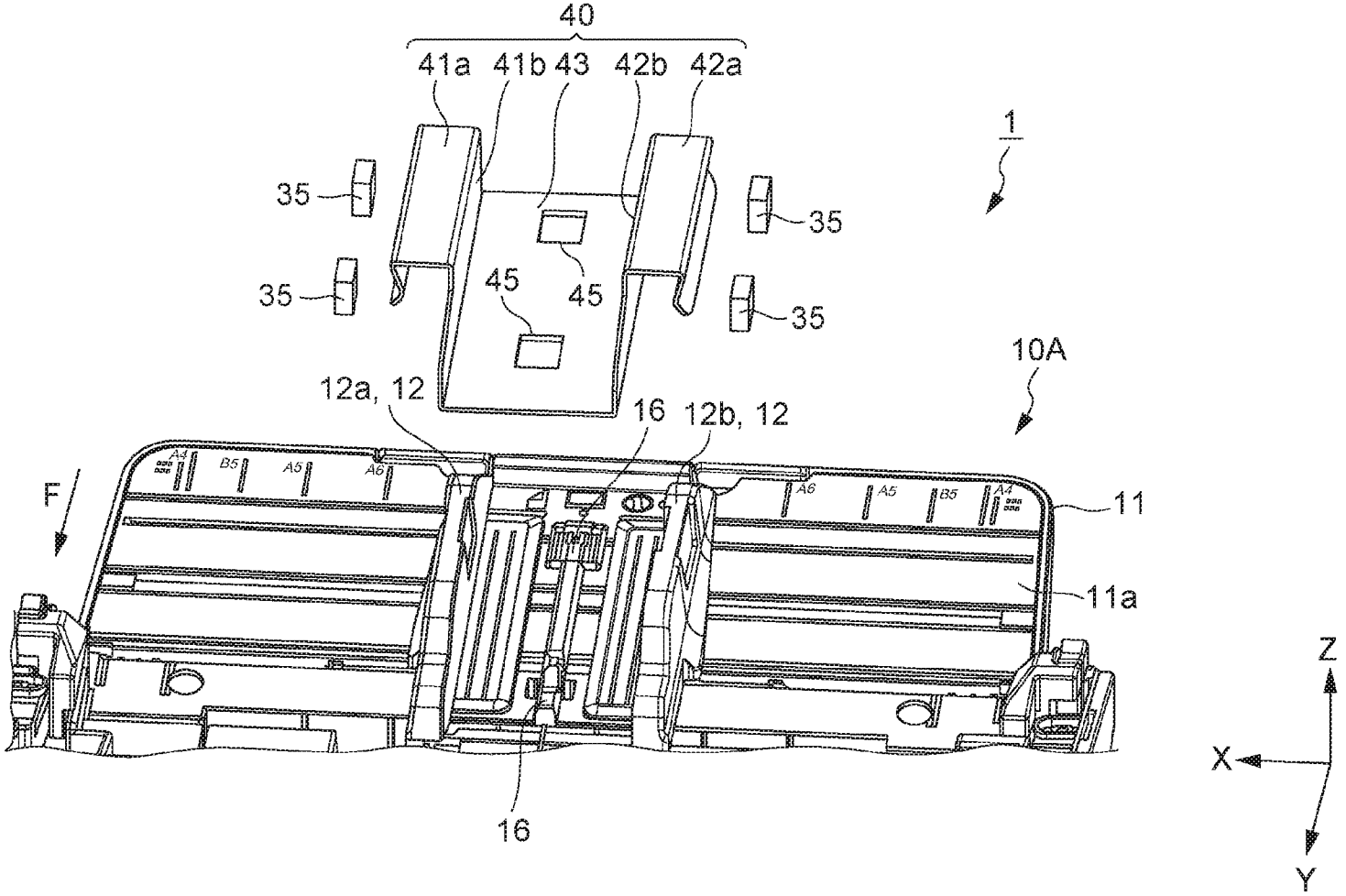
FIG. 7 is an exploded perspective view illustrating a part to which a width adjuster of a medium feeding apparatus according to the second embodiment is attached.

FIG. 6, which corresponds to FIG. 3, is a perspective view illustrating a part to which a width adjuster 40 of a medium feeding apparatus 10A according to the second embodiment is attached. FIG. 7, which corresponds to FIG. 4, is an exploded perspective view illustrating a part to which the width adjuster 40 of the medium feeding apparatus 10A according to the embodiment is attached. The shape of the width adjuster in the medium feeding apparatus 10A according to the embodiment differs from the shape of the width adjuster in the medium feeding apparatus 10 according to the first embodiment. The difference is a major difference between the second embodiment and the first embodiment. Hereinafter, with reference to FIG. 6 and FIG. 7, an outline of the medium feeding apparatus 10A according to the embodiment will be described, focusing on differences from the first embodiment. To components similar to those in the first embodiment, same reference numerals are given to omit their overlapping descriptions.

As illustrated in FIG. 6 and FIG. 7, the width adjuster 40 of the medium feeding apparatus 10A according to the embodiment is a single component. On the other hand, the width adjuster 30 of the medium feeding apparatus 10 according to the first embodiment comprises two components (the first adjuster 31 and the second adjuster 32) (see FIG. 3). The width adjuster 40 includes a first holding section 41*a* for holding the first edge guide 12*a*, a first guiding section 41*b* for guiding the edge of a special size medium P on the +X direction side, a base portion 43 on which the special size medium P is mounted, a second guiding section 42*b* for guiding the edge of the special size medium P on the −X direction side, and a second holding section 42*a* for holding the second edge guide 12*b*. The holding sections 41*a* and 42*a* are sections for holding the edge guide 12 in the width adjuster 40 when the width adjuster 40 is attached to the edge guide 12. The guiding sections 41*b* and 42*b* are sections for guiding edges of a special size medium P in the width adjuster 40 that is attached to the edge guide 12 when the special size medium P mounted on the base portion 43 is fed in the sheet feeding direction F.

The elastic members 35 are disposed in a compressed state between the holding sections 41*a* and 42*a* and the edge guide 12 respectively to apply a force from the elastic members 35 to press the holding sections 41*a* and 42*a* against the edge guides 12*a* and 12*b* to fix the width adjuster 40 to the edge guide 12. The width adjuster 40 is attached to the edge guides 12*a* and 12*b* by a user with the elastic members 35 being disposed inside the holding sections 41*a* and 42*a* by pressing the width adjuster 40 in the −Z direction such that the holding sections 41*a* and 42*a* hold parts of the edge guides 12*a* and 12*b*. The width adjuster 40 is detached from the edge guides 12*a* and 12*b* by a user by pulling the width adjuster 40 that is being attached to the edge guides 12*a* and 12*b* in the +Z direction. As described above, the width adjuster 40 can be attached to or detached from the edge guide 12 by simply pressing the width adjuster 40 in the −Z direction or by simply pulling the width adjuster 40 in the +Z direction.

The base portion 43 of the width adjuster 40 has holes 45 for exposing the rotation members 16 of the medium mounting section 11 when the width adjuster 40 is attached to the edge guide 12. With this structure, when a special size medium P mounted on the width adjuster 40 is fed in the sheet feeding direction F, the rotation members 16 facilitate the feeding of the special size medium P in the sheet feeding direction F.

The width adjuster 40 is a single component, and the distance between the first guiding section 41*b* and the second guiding section 42*b* is constant and does not change. For example, if the width adjuster 40 consists of a plurality of components, the distance between the components (the first guiding section 41*b* and the second guiding section 42*b*) may change. For example, if the distance between the first guiding section 41*b* and the second guiding section 42*b* changes while the first guiding section 41*b* and the second guiding section 42*b* are guiding a special size medium P and spaces are formed between the guiding sections 41*b* and 42*b* and the edges of the special size medium P respectively, the special size medium P may not be fed in the sheet feeding direction F. The width adjuster 40 consisting of the single component stably transports the special size medium P in the sheet feeding direction F with the constant distance between the first guiding section 41*b* and the second guiding section 42*b* as compared with the width adjuster in which the distance between the first guiding section 41*b* and the second guiding section 42*b* may change.

Furthermore, the width adjuster 40 consisting of the single component requires fewer steps for attaching or detaching the width adjuster 40 to or from the edge guides 12*a* and 12*b* than the width adjuster 40 consisting of two components, and thus the width adjuster 40 can be readily attached or detached to or from the edge guides 12*a* and 12*b*.

With this structure, the width adjuster 40 of the medium feeding apparatus 10A according to the embodiment can properly guide a special size medium P similarly to the width adjuster 30 of the medium feeding apparatus 10 according to the first embodiment. The medium feeding apparatus 10A according to the embodiment provided with the width adjuster 40 can properly feed a special size medium P in the sheet feeding direction F similarly to the medium feeding apparatus 10 according to the first embodiment provided with the width adjuster 30. The scanner 1 including the medium feeding apparatus 10A according to the embodiment can properly read an image on a special size medium P.

3. Third Embodiment

Figure 8:
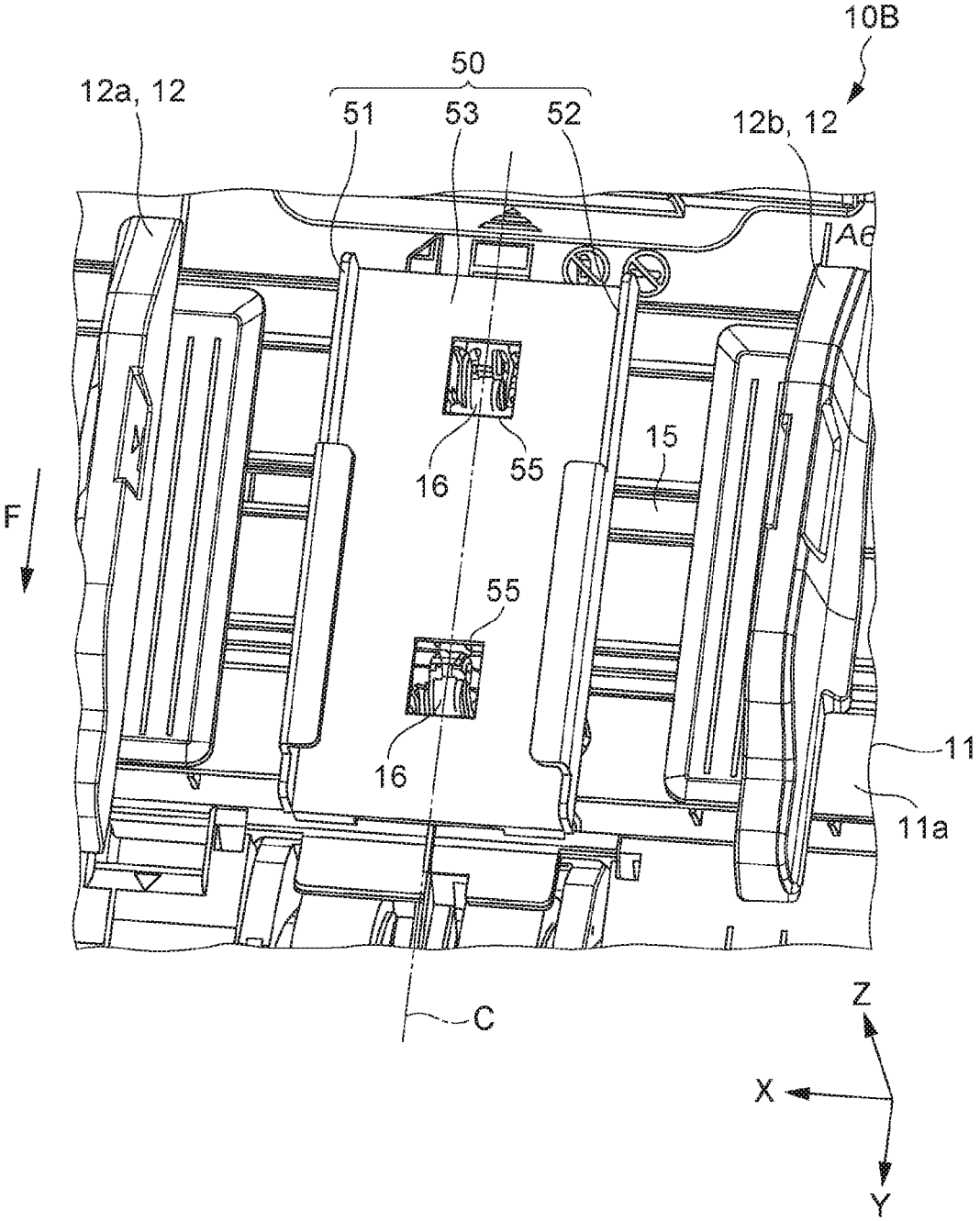
FIG. 8 is a perspective view illustrating a part to which a width adjuster of a medium feeding apparatus according to a third embodiment is attached.
Figure 9:
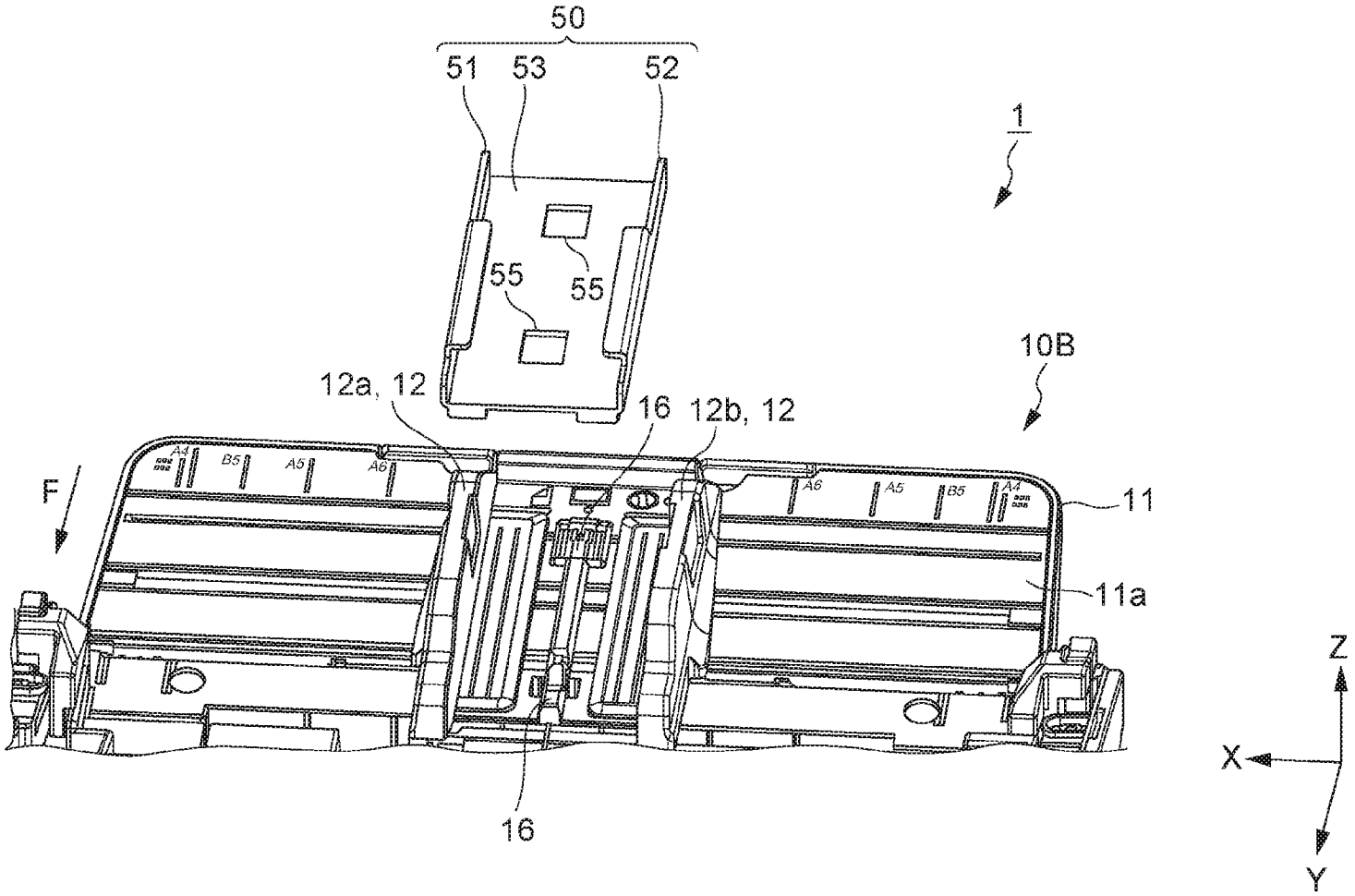
FIG. 9 is an exploded perspective view illustrating a part to which a width adjuster of a medium feeding apparatus according to the third embodiment is attached.
Figure 10:
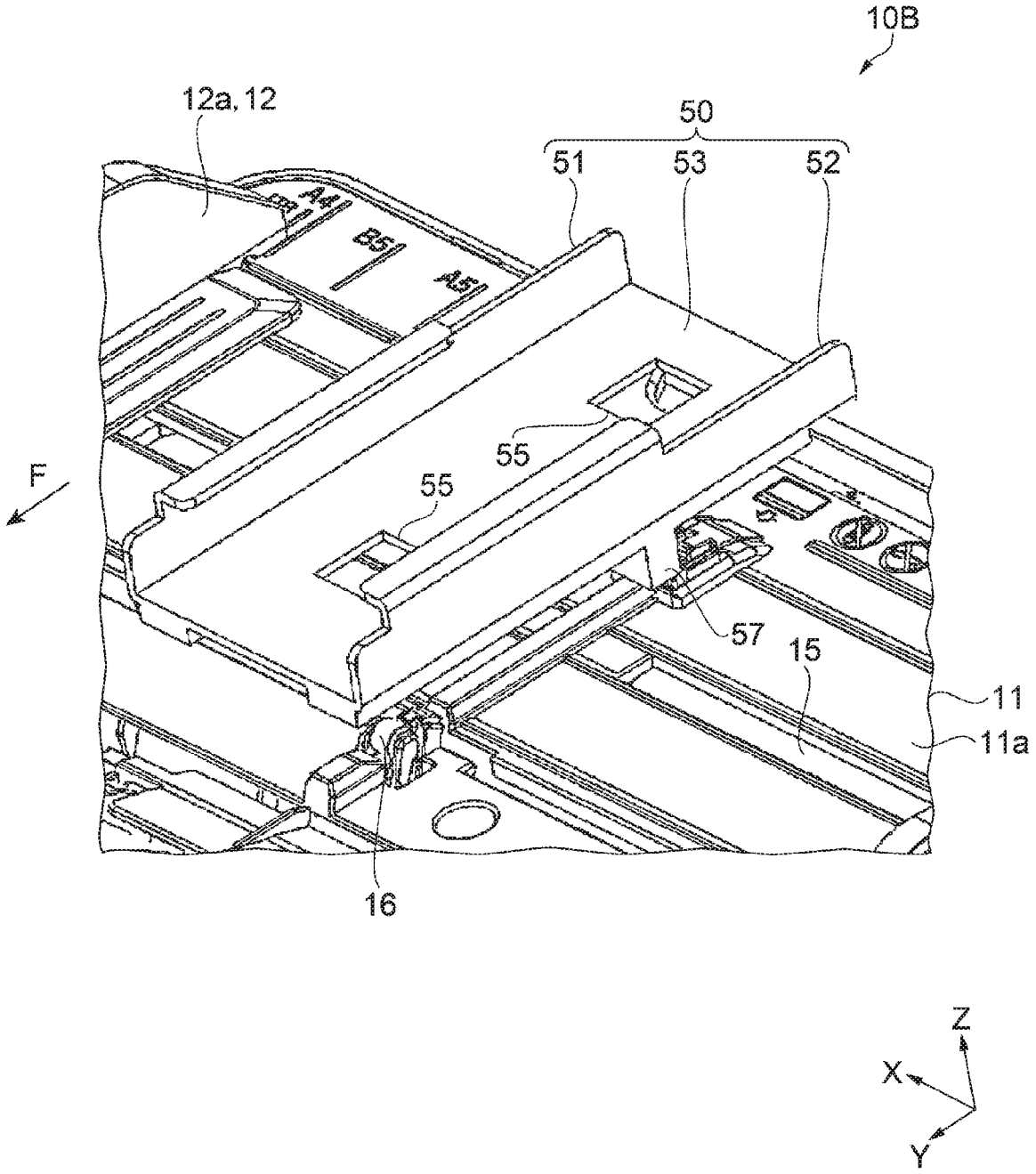
FIG. 10 is another perspective view illustrating the part to which the width adjuster of the medium feeding apparatus according to the third embodiment is attached.

FIG. 8, which corresponds to FIG. 6, is a perspective view illustrating a part to which a width adjuster 50 of a medium feeding apparatus 10B according to the third embodiment is attached. FIG. 9, which corresponds to FIG. 7, is an exploded perspective view illustrating a part to which the width adjuster 50 of the medium feeding apparatus 10B according to the embodiment is attached. FIG. 10 is another exploded perspective view illustrating a part to which the width adjuster 50 of the medium feeding apparatus 10B according to the embodiment is attached. FIG. 8 is a perspective view of the medium mounting section 11 to which the width adjuster 50 has been attached. FIG. 10 is a perspective view of the medium mounting section 11 before the width adjuster 50 is attached thereto. The section to which the width adjuster is attached in the medium feeding apparatus 10B according to the embodiment differs from the section to which the width adjuster is attached in the medium feeding apparatus 10A according to the second embodiment. In this embodiment, the width adjuster 50 is attached to the medium mounting section 11, whereas in the second embodiment, the width adjuster 40 is attached to the edge guide 12. The difference is a major difference between the third embodiment and the second embodiment. Hereinafter, with reference to FIG. 8 and FIG. 10, an outline of the medium feeding apparatus 10B according to the embodiment will be described, focusing on differences from the second embodiment.

As illustrated in FIG. 8 to FIG. 10, the width adjuster 50 of the medium feeding apparatus 10B according to the embodiment is a single component similarly to the width adjuster 40 of the medium feeding apparatus 10A according to the second embodiment. The width adjuster 50 includes a first guiding section 51 for guiding the edge of a special size medium P on the +X direction side, a base portion 53 on which the special size medium P is mounted, and a second guiding section 52 for guiding the edge of the special size medium P on the −X direction side. The guiding sections 51 and 52 are sections for guiding edges of a special size medium P in the width adjuster 50 when the special size medium P mounted on the base portion 53 is fed in the sheet feeding direction F. The width adjuster 50 has holes 55 for exposing the rotation members 16 when the width adjuster 50 is attached to the medium mounting section 11. These components (the guiding sections 51 and 52, the base portion 53, the holes 55) correspond to the components (the guiding sections 41*b* and 42*b*, the base portion 43, the holes 45) of the width adjuster 40 according to the second embodiment respectively, and function similarly.

The base portion 53 has a convex portion 57 on a side opposite to the side on which a special size medium P is mounted (see FIG. 10). The convex portion 57 of the base portion 53 is fitted into the slit 15 of the medium mounting section 11 to attach the width adjuster 50 to the medium mounting section 11, and thereby the width adjuster 50 is fixed to the medium mounting section 11. This structure is different from the structure according to the second embodiment. The convex portion 57 of the base portion 53 is an example engaging portion according to the embodiment, and the slit 15 of the medium mounting section 11 is an example engaged portion according to the embodiment. The width adjuster 50 has the engaging portion (convex portion 57) that is fitted into the engaged portion (slit 15) of the medium mounting section 11.

The engaging portion according to the embodiment is the hole (slit 15) that is a through hole in the mounting surface 11*a* of the medium mounting section 11; alternatively, the engaging portion according to the embodiment may be a concave portion in the mounting surface 11*a* of the medium mounting section 11. Accordingly, the engaged portion according to the embodiment is a concave portion or a hole in the mounting surface 11*a* of the medium mounting section 11.

The width adjuster 50 is attached to the medium mounting section 11 by a user by pressing the width adjuster 50 in the −Z direction such that the convex portion 57 of the width adjuster 50 is fitted into the slit 15 of the medium mounting section 11. The width adjuster 50 is detached from the medium mounting section 11 by a user by pulling the width adjuster 50 in the +Z direction. As described above, the width adjuster 50 can be attached to or detached from the medium mounting section 11 by simply pressing the width adjuster 50 or by simply pulling the width adjuster 50.

In a state in which the width adjuster 50 is attached to the medium mounting section 11, the first edge guide 12*a*, the first guiding section 51, a central portion C in the medium mounting section 11 indicated by the alternate long and short dashed lines in FIG. 8, the second guiding section 52, and the second edge guide 12*b* are disposed in this order along a direction (−X direction) intersecting the sheet feeding direction F (see FIG. 8). When the width adjuster 50 guides the edges of a medium P mounted on the base portion 53, the first guiding section 51 guides the +X-side edge of the medium P at a position closer to the central portion C in the medium mounting section 11 than the first edge guide 12*a*, and the second guiding section 52 guides the −X-side edge of the medium P at a position closer to the central portion C in the medium mounting section 11 than the second edge guide 12*b*.

With this structure, in guiding the edges of a medium P by the width adjuster 50, as compared with the structure in which the edge guide 12 guides edges of a medium P, the width of the guided medium P is narrow, and thus the width adjuster 50 can guide the edges of a special size medium P. Accordingly, the width adjuster 50 of the medium feeding apparatus 10B according to the embodiment can properly guide a special size medium P similarly to the width adjuster 40 of the medium feeding apparatus 10A according to the second embodiment. The medium feeding apparatus 10B provided with the width adjuster 50 can properly feed a special size medium P in the sheet feeding direction F similarly to the medium feeding apparatus 10A according to the second embodiment provided with the width adjuster 40. The scanner 1 including the medium feeding apparatus 10B according to the embodiment can properly read an image on a special size medium P.

4. Fourth Embodiment

Figure 11:
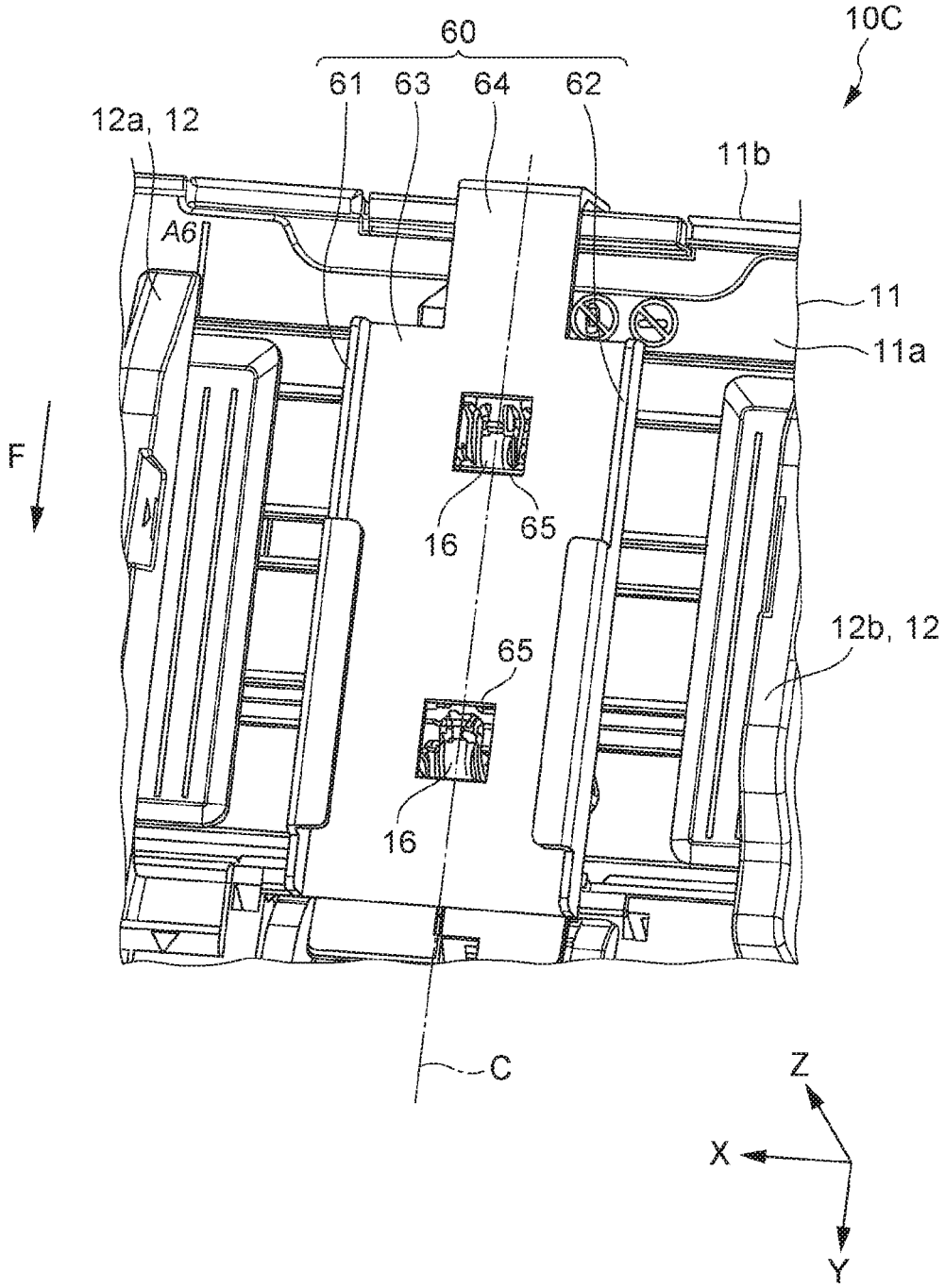
FIG. 11 is a perspective view illustrating a part to which a width adjuster of a medium feeding apparatus according to a fourth embodiment is attached.
Figure 12:
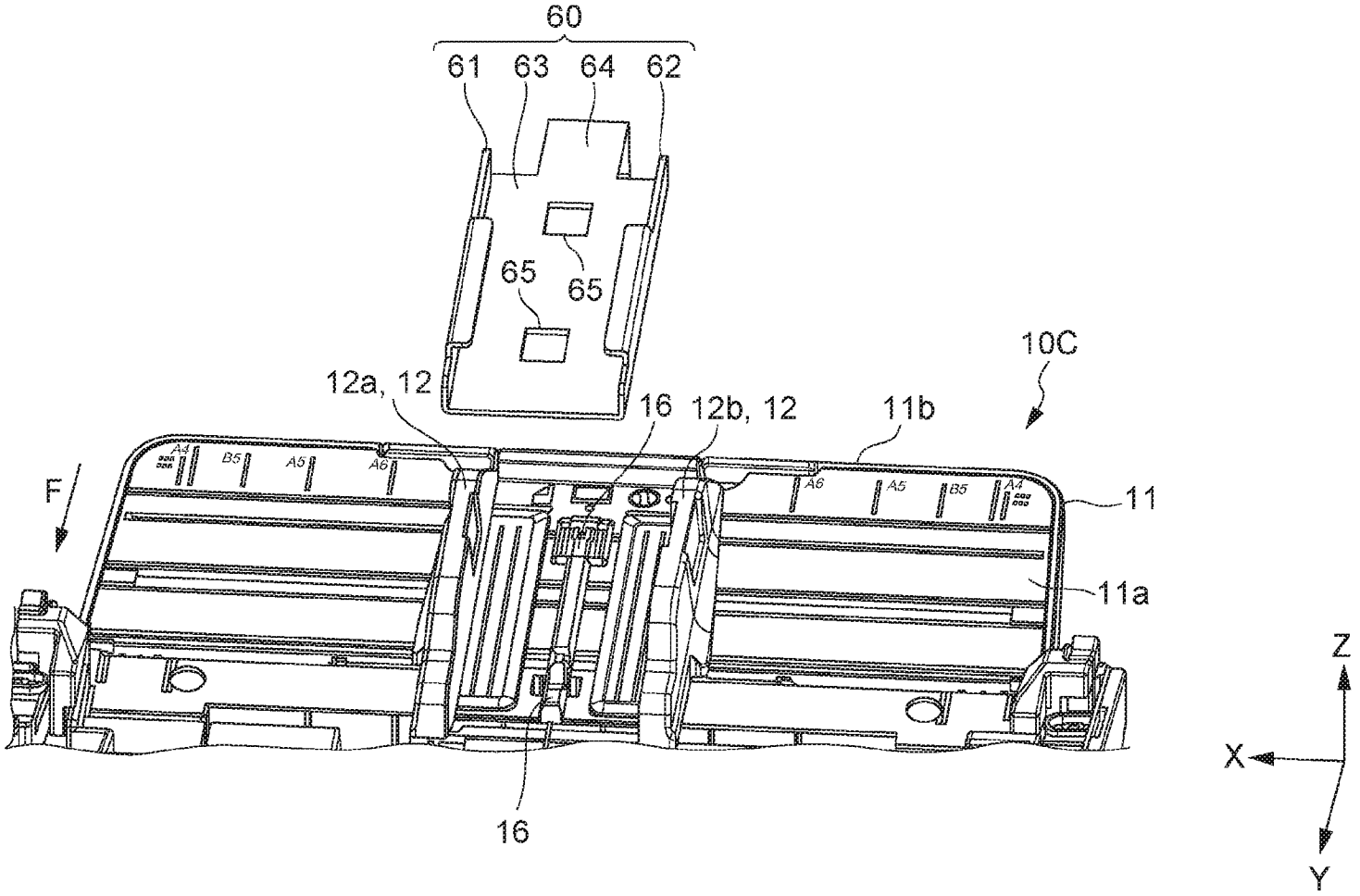
FIG. 12 is an exploded perspective view illustrating a part to which a width adjuster of a medium feeding apparatus according to the fourth embodiment is attached.

FIG. 11, which corresponds to FIG. 6, is a perspective view illustrating a part to which a width adjuster 60 of a medium feeding apparatus 10C according to the fourth embodiment is attached. FIG. 12, which corresponds to FIG. 7, is an exploded perspective view illustrating a part to which the width adjuster 60 of the medium feeding apparatus 10C according to the embodiment is attached.

The part to which the medium feeding apparatus 10C according to the embodiment is attached differs from the part to which the medium feeding apparatus 10A according to the second embodiment is attached. In this embodiment, the width adjuster 60 is attached to the medium mounting section 11, whereas in the second embodiment, the width adjuster 40 is attached to the edge guide 12. This difference is a major difference between the fourth embodiment and the second embodiment. Hereinafter, with reference to FIG. 11 and FIG. 12, an outline of the medium feeding apparatus 10C according to the embodiment will be described, focusing on differences from the second embodiment.

As illustrated in FIG. 11 and FIG. 12, the width adjuster 60 of the medium feeding apparatus 10C according to the embodiment is a single component similarly to the width adjuster 40 of the medium feeding apparatus 10A according to the second embodiment. The width adjuster 60 includes a first guiding section 61 for guiding the +X-direction side edge of a special size medium P, a base portion 63 on which the special size medium P is mounted, and a second guiding section 62 for guiding the −X-direction side edge of the special size medium P. The guiding sections 61 and 62 are sections for guiding edges of a special size medium P in the width adjuster 60 when the special size medium P mounted on the base portion 63 is fed in the sheet feeding direction F. The width adjuster 60 has holes 65 for exposing the rotation members 16 when the width adjuster 60 is attached to the medium mounting section 11. These components (the guiding sections 61 and 62, the base portion 63, the holes 65) correspond to the components (the guiding sections 41*b* and 42*b*, the base portion 43, the holes 45) of the width adjuster 40 according to the second embodiment respectively, and function similarly.

The width adjuster 60 has a grip portion 64 at an end on the −Y direction side. The grip portion 64 has a U-shaped cross section capable of gripping an end 11*b* of the medium mounting section 11 on the −Y direction side. The grip portion 64 grips the end 11*b* of the medium mounting section 11 on the −Y direction side, and thereby the width adjuster 60 is attached to the medium mounting section 11 and the width adjuster 60 is fixed to the medium mounting section 11. This structure is different from the structure according to the second embodiment. The grip portion 64 of the width adjuster 60 is an example engaging portion according to the embodiment, and the end 11*b* of the medium mounting section 11 on the −Y direction side is an example engaged portion according to the embodiment. The width adjuster 60 has the engaging portion (the grip portion 64) that engages with the engaged portion (the end lib on the −Y direction side) of the medium mounting section 11.

The width adjuster 60 is attached to the medium mounting section 11 by a user by pressing the width adjuster 60 onto the end lib of the medium mounting section 11 on the −Y direction side such that the grip portion 64 of the width adjuster 60 grips the end lib of the medium mounting section 11 on the −Y direction side. The width adjuster 60 is detached from the medium mounting section 11 by a user by pulling the width adjuster 60 to separate the grip portion 64 of the width adjuster 60 from the end lib of the medium mounting section 11 on the −Y direction side. As described above, the width adjuster 60 can be attached to or detached from the medium mounting section 11 by simply pressing the width adjuster 60 or by simply pulling the width adjuster 60.

In a state in which the width adjuster 60 is attached to the medium mounting section 11, the first edge guide 12*a*, the first guiding section 61, a central portion C in the medium mounting section 11 indicated by the alternate long and short dashed lines in FIG. 11, the second guiding section 62, and the second edge guide 12*b* are disposed in this order along a direction (−X direction) intersecting the sheet feeding direction F (see FIG. 11). When the width adjuster 60 guides the edges of a medium P mounted on the base portion 63, the first guiding section 61 guides the +X-direction side edge of the medium P at a position closer to the central portion C in the medium mounting section 11 than the first edge guide 12*a*, and the second guiding section 62 guides the −X-direction side edge of the medium P at a position closer to the central portion C in the medium mounting section 11 than the second edge guide 12*b*.

With this structure, in guiding the edges of a medium P by the width adjuster 60, as compared with the structure in which the edge guide 12 guides the edges of the medium P, the width of the guided medium P is narrow, and thus the width adjuster 60 can guide the edges of a special size medium P. Accordingly, the width adjuster 60 of the medium feeding apparatus 10C according to the embodiment can properly guide a special size medium P similarly to the width adjuster 40 of the medium feeding apparatus 10A according to the second embodiment. Furthermore, the medium feeding apparatus 10C provided with the width adjuster 60 can properly feed a special size medium P in the sheet feeding direction F similarly to the medium feeding apparatus 10A according to the second embodiment provided with the width adjuster 40. The scanner 1 including the medium feeding apparatus 10C according to the embodiment can properly read an image on a special size medium P.

5. Fifth Embodiment

Figure 13:
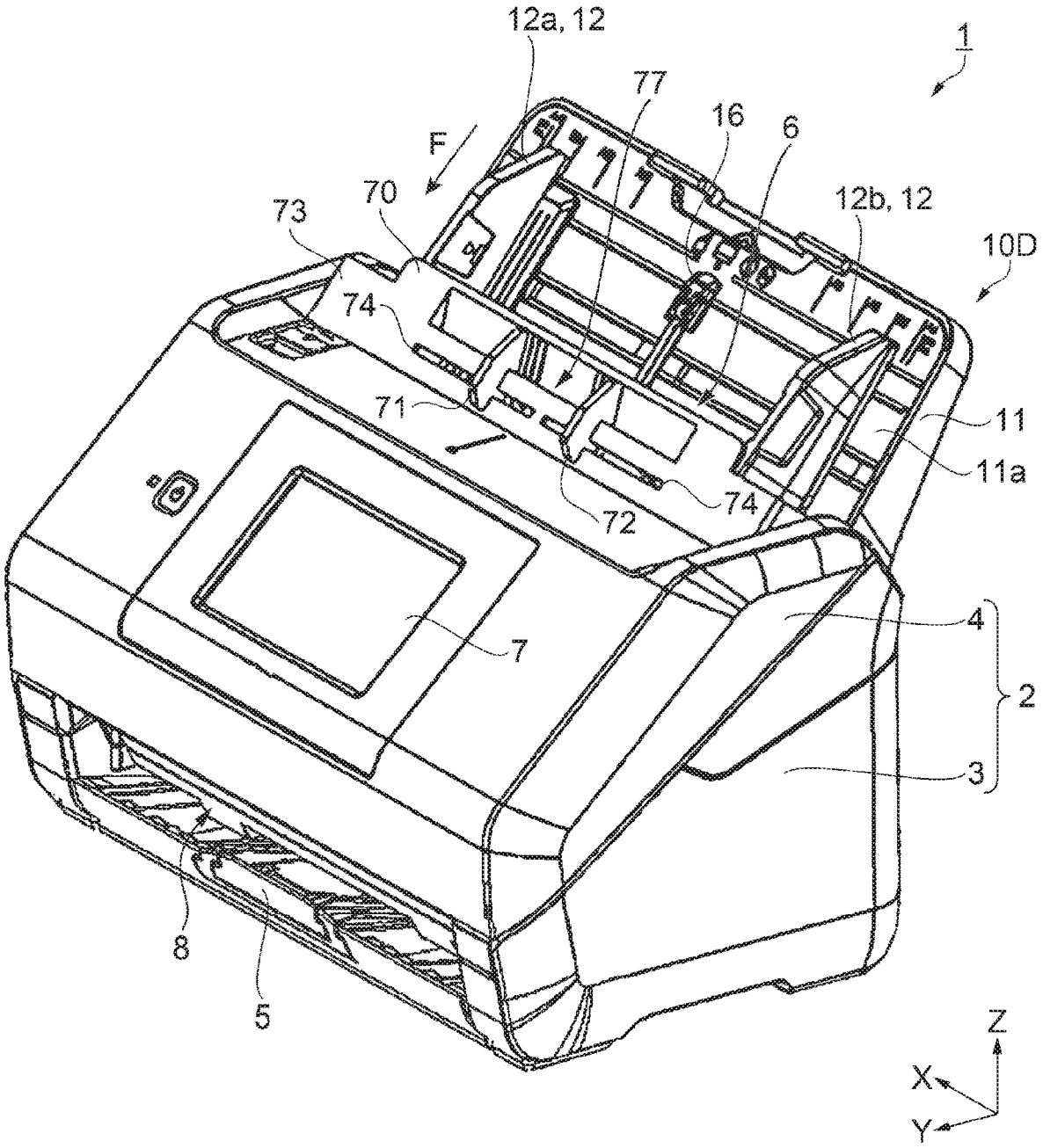
FIG. 13 is a perspective view illustrating a scanner to which a width adjuster of a medium feeding apparatus according to a fifth embodiment is attached.
Figure 14:
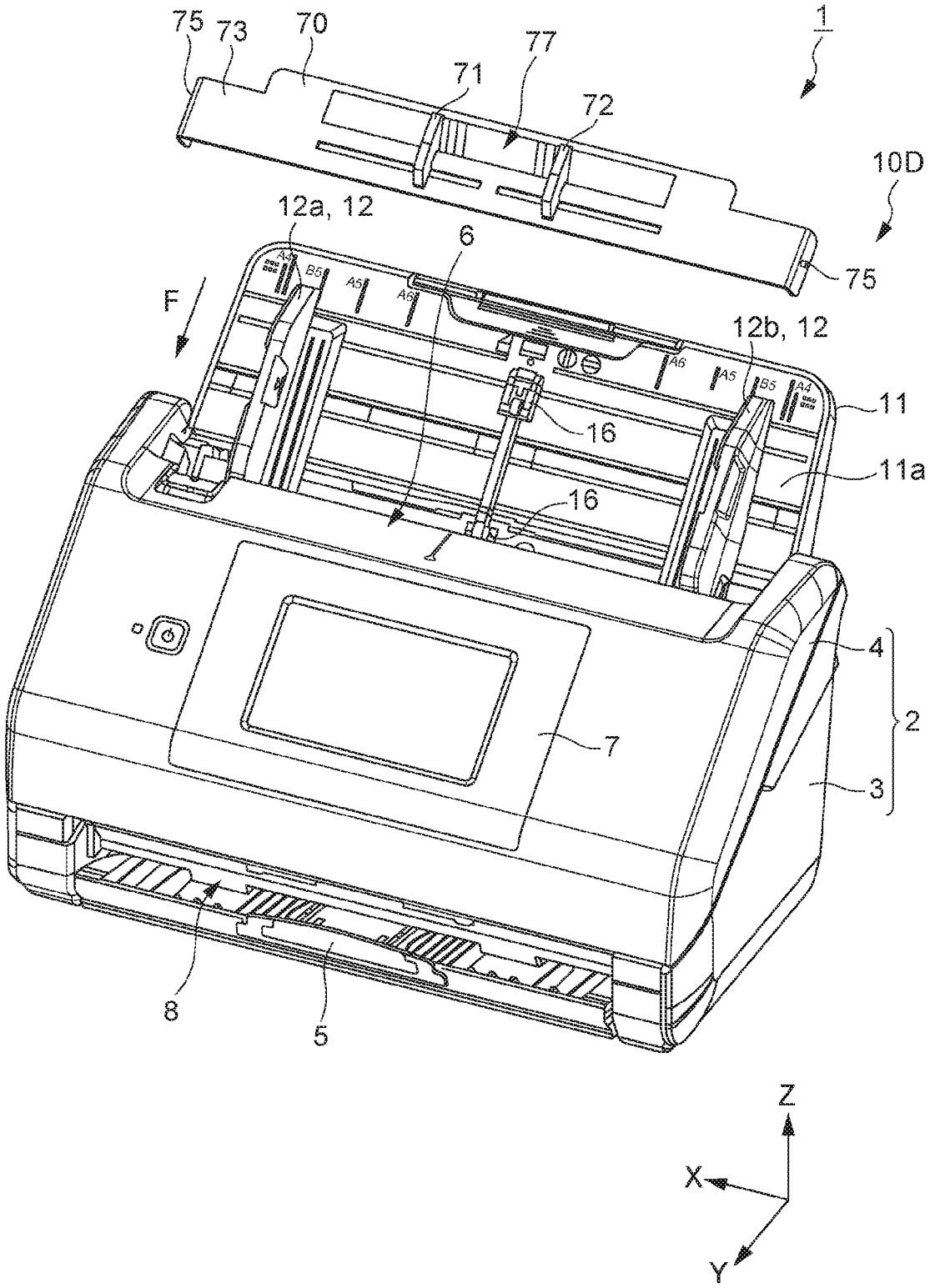
FIG. 14 is an exploded perspective view illustrating a scanner to which a width adjuster of a medium feeding apparatus according to the fifth embodiment is attached.

FIG. 13 is a perspective view illustrating the scanner 1 to which a width adjuster 70 of a medium feeding apparatus 10D according to the fifth embodiment is attached. FIG. 14 is an exploded perspective view illustrating the scanner 1 to which the width adjuster 70 of the medium feeding apparatus 10D according to the embodiment is attached. The shape of the width adjuster of the medium feeding apparatus 10D according to the embodiment differs from the shape of the width adjuster of the medium feeding apparatus 10 according to the first embodiment. The difference is a major difference between the fifth embodiment and the first embodiment. Hereinafter, with reference to FIG. 13 and FIG. 14, an outline of the medium feeding apparatus 10D according to the embodiment will be described, focusing on differences from the first embodiment. To components similar to those in the first embodiment, same reference numerals are given to omit their overlapping descriptions.

As illustrated in FIG. 13, the scanner 1 according to the embodiment is provided with two medium feed slots 6 and 77. More specifically, the medium feeding apparatus 10D according to the embodiment is provided with two medium feed slots 6 and 77. In the medium feeding apparatus 10D according to the embodiment, a medium P can be fed into the reading section 20 from one of the two medium feed slots 6 and 77. The medium feed slot 77 of the two medium feed slots 6 and 77 is an example feed slot according to the embodiment.

The medium feed slot 6 of the two medium feed slots 6 and 77 is a first slot for medium P and is defined by the first edge guide 12*a* and the second edge guide 12*b*. The width (size in the X direction) of the medium feed slot 6 ranges approximately from 50 mm to 210 mm (A4 size). In the medium feed slot 6, a minimum width of the medium P that is guided with the first edge guide 12*a* and the second edge guide 12*b* is approximately 50 mm.

As illustrated in FIGS. 13 and 14, the width adjuster 70 includes a first guiding section 71 for guiding the +X-direction side edge of a medium P, a second guiding section 72 for guiding the −X-direction side edge of the medium P, and a base portion 73 that supports the guiding sections 71 and 72.

The medium feed slot 77 of the two medium feed slots 6 and 77 is a second slot for medium P that is defined by the first guiding section 71 and the second guiding section 72, and a second slot for medium P in the width adjuster 70. The width (size in the X direction) of the medium feed slot 77 ranges approximately from 44 mm to 105 mm (A6 size). A minimum width of the medium feed slot 77 for guiding a medium P with the first guiding section 71 and the second guiding section 72 is approximately 44 mm. With this structure according to the embodiment, the minimum width for guiding a medium P with the first guiding section 71 and the second guiding section 72 is narrower than the minimum width for guiding a medium P with the first edge guide 12*a* and the second edge guide 12*b*. Accordingly, the width adjuster 70 of the medium feeding apparatus 10D according to the embodiment can properly guide a special size medium P.

The base portion 73 has a slit 74 that is long in the X direction. Although not illustrated, parts of the guiding sections 71 and 72 are inserted into the slit 74. With this structure, the guiding sections 71 and 72 can be slid in the X direction with the slit 74. The first guiding section 71 can be moved in the same direction as the first edge guide 12*a*. The second guiding section 72 can be moved in the same direction as the second edge guide 12*b*.

The first guiding section 71 of the guiding sections 71 and 72 may be moved in the same direction as the first edge guide 12*a*, or the second guiding section 72 of the guiding sections 71 and 72 may be moved in the same direction as the second edge guide 12*b*. More specifically, at least one of the first guiding section 71 and the second guiding section 72 is moved in the same direction as the first edge guide 12*a* or the second edge guide 12*b*.

Furthermore, convex portions 75 that extend toward the apparatus body 2 are provided at a +X-direction side edge and a −X-direction side edge of the base portion 73. The convex portions 75 are an example fixing section according to the embodiment. Although not illustrated, the apparatus body 2 has concave portions with which the convex portions 75 of the base portion 73 can be engaged and grooves that guide the convex portions 75 of the base portion 73 to the concave portions. The convex portions 75 of the base portion 73 are engaged with the concave portions of the apparatus body 2 to attach the width adjuster 70 to the apparatus body 2, and thereby the width adjuster 70 is fixed to the apparatus body 2. With this structure, the convex portions 75 (fixing section) of the base portion 73 in the width adjuster 70 are fixed to the apparatus body 2 (body section).

The edge guide 12 may have concave portions with which the convex portions 75 of the base portion 73 are engaged, and by engaging the convex portions 75 of the base portion 73 with the concave portions of the edge guide 12, the width adjuster 70 is attached to the edge guide 12 and the width adjuster 70 is fixed to the edge guide 12. The medium mounting section 11 may have concave portions with which the convex portions 75 of the base portion 73 are engaged, and by engaging the convex portions 75 of the base portion 73 with the concave portions of the medium mounting section 11, the width adjuster 70 is attached to the medium mounting section 11 and the width adjuster 70 is fixed to the medium mounting section 11. More specifically, the convex portions 75 (fixing section) of the base portion 73 may be fixed to at least one of the apparatus body 2, the edge guide 12, and the medium mounting section 11.

A user fits the convex portions 75 of the base portion 73 into the grooves of the apparatus body 2 and presses the base portion 73 in the sheet feeding direction F, and the convex portions 75 of the base portion 73 are guided by the grooves of the apparatus body 2 to the concave portions of the apparatus body 2 and engage with the concave portions of the apparatus body 2, and thereby the width adjuster 70 is attached to the apparatus body 2. The width adjuster 70 can be detached from the apparatus body 2 by a user by pulling the base portion 73 in the direction opposite to the sheet feeding direction F. As described above, the width adjuster 70 can be attached to or detached from the apparatus body 2 by simply pressing the width adjuster 70 in the sheet feeding direction F or by simply pulling the width adjuster 70 in the direction opposite to the sheet feeding direction F.

As described above, the width adjuster 70 of the medium feeding apparatus 10D according to the embodiment can properly guide a special size medium P similarly to the width adjuster 30 of the medium feeding apparatus 10 according to the first embodiment. The medium feeding apparatus 10D according to the embodiment provided with the width adjuster 70 can properly feed a special size medium P in the sheet feeding direction F similarly to the medium feeding apparatus 10 according to the first embodiment provided with the width adjuster 30. The scanner 1 including the medium feeding apparatus 10D according to the embodiment can properly read an image on a special size medium P.

6. First Modification

Figure 15:
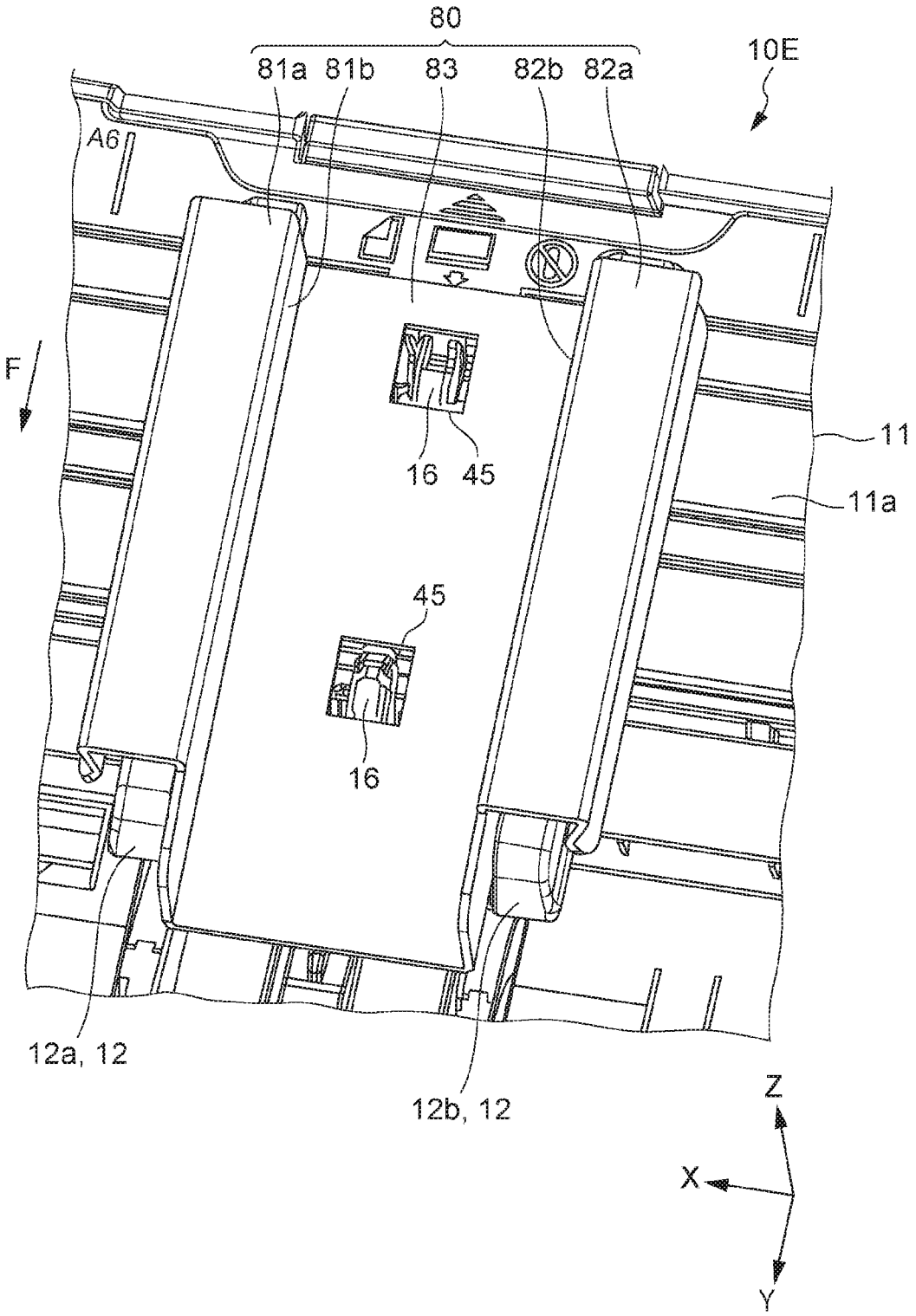
FIG. 15 is a perspective view illustrating a part to which a width adjuster of a medium feeding apparatus according to a first modification is attached.

FIG. 15, which corresponds to FIG. 6, is a perspective view illustrating a part to which a width adjuster 80 of a medium feeding apparatus 10E according to the first modification is attached. The length of the width adjuster according to the first modification differs from the length of the width adjuster according to the second embodiment. More specifically, in the sheet feeding direction F, the length of the width adjuster 80 of the medium feeding apparatus 10E according to the modification is longer than the length of the width adjuster 40 of the medium feeding apparatus 10A according to the second embodiment. This difference is a difference between the modification and the second embodiment. Hereinafter, with reference to FIG. 15, the width adjuster 80 of the medium feeding apparatus 10E according to the modification will be described, focusing on differences from the second embodiment.

As illustrated in FIG. 15, the width adjuster 80 includes a first holding section 81*a* for holding the first edge guide 12*a*, a first guiding section 81*b* for guiding the +X-direction side edge of a special size medium P, a base portion 83 on which the special size medium P is mounted, a second guiding section 82*b* for guiding the −X-direction side edge of the special size medium P, and a second holding section 82*a* for holding the second edge guide 12*b*. These components (the holding sections 81*a* and 82*a*, the guiding sections 81*b* and 82*b*, and the base portion 83) correspond to the components (the holding sections 41*a* and 42*a*, the guiding sections 41*b* and 42*b*, and the base portion 43) of the width adjuster 40 according to the second embodiment respectively, and function similarly.

In the modification, the first guiding section 81*b* extends downstream longer in the sheet feeding direction F than first edge guide 12*a*, and the second guiding section 82*b* extends downstream longer in the sheet feeding direction F than the second edge guide 12*b*. In the sheet feeding direction F, the first guiding section 81*b* is longer than the first edge guide 12*a*, and the second guiding section 82*b* is longer than the second edge guide 12*b*. More specifically, in the sheet feeding direction F, the lengths of the portions (the first guiding section 81*b* and the second guiding section 82*b*) for guiding a medium P in the attached width adjuster 80 are longer than the lengths of the portions (the first edge guide 12*a* and the second edge guide 12*b*) for guiding the medium P without the width adjuster 80 being attached. Furthermore, in the sheet feeding direction F, the lengths of the portions (the first guiding section 81*b* and the second guiding section 82*b*) for guiding a medium P in the attached width adjuster 80 according to the modification are longer than the lengths of the portions (the first guiding section 41*b* and the second guiding section 42*b*) for guiding the medium P without the width adjuster 40 according to the second embodiment being attached.

With this structure, the lengths of the portions for guiding a medium P in the width adjuster 80 of the medium feeding apparatus 10E according to the modification are longer than those in the width adjuster 40 of the medium feeding apparatus 10A according to the second embodiment, and thus the width adjuster 80 can properly guide a long thin special size medium P such as a long sales slip. Accordingly, the medium feeding apparatus 10E according to the modification provided with the width adjuster 80 can properly feed a long thin special size medium P in the sheet feeding direction F. The scanner 1 including the medium feeding apparatus 10E according to the modification can properly read an image on a long thin special size medium P.

Similarly to the width adjuster 80 according to the modification, in the width adjusters 30, 40, 50, 60, and 70 according to the above-described embodiments, longer portions for guiding a medium P in the sheet feeding direction F can properly guide a long thin special size medium P. The medium feeding apparatuses 10, 10A, 10B, 10C, and 10D provided with the width adjusters 30, 40, 50, 60, and 70 that have longer portions for guiding a medium P in the sheet feeding direction F respectively can properly feed a long thin special size medium P similarly to the medium feeding apparatus 10E according to the modification provided with the width adjuster 80. The scanner 1 including the medium feeding apparatus 10, 10A, 10B, 10C, or 10D can properly read an image on a long thin special size medium P.

7. Second Modification

Figure 16:
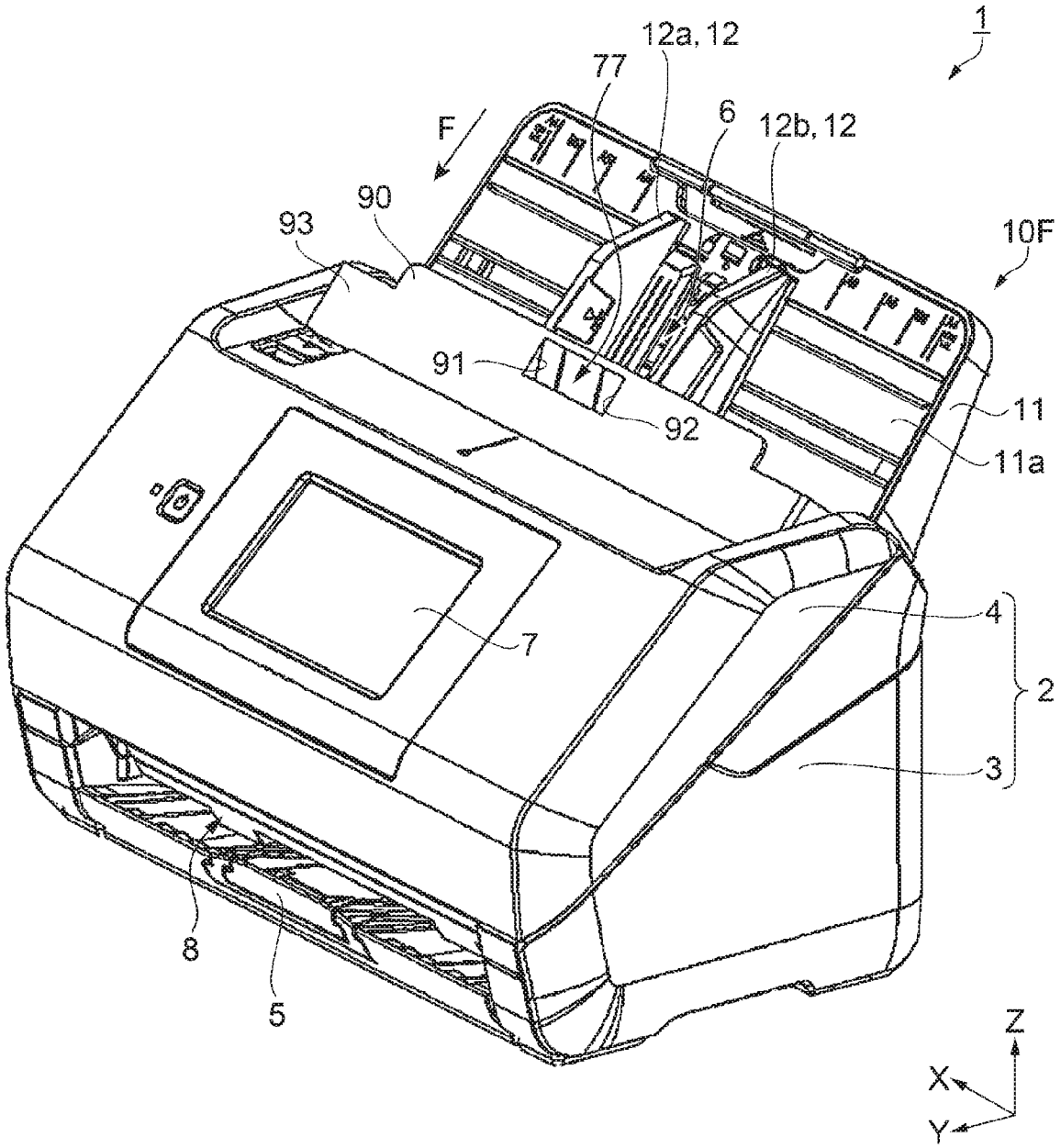
FIG. 16 is a perspective view illustrating a scanner to which a width adjuster of a medium feeding apparatus according to a second modification is attached.

FIG. 16, which corresponds to FIG. 13, is a perspective view illustrating a part to which a width adjuster 90 of a medium feeding apparatus 10F according to the second modification is attached. The shape of the width adjuster according to the modification differs from the shape of the width adjuster according to the fifth embodiment. This difference is a difference between the second modification and the fifth embodiment. Hereinafter, with reference to FIG. 16, the width adjuster 90 of the medium feeding apparatus according to the modification will be described, focusing on differences from the fifth embodiment.

As illustrated in FIG. 16, the width adjuster 90 includes a first guiding section 91 for guiding the +X-direction side edge of a medium P, a second guiding section 92 for guiding the −X-direction side edge of the medium P, and a base portion 93 that has guiding sections 91 and 92. The first guiding section 91, the second guiding section 92, and the base portion 93 are integrally formed, for example, by molding using a resin as a raw material. Accordingly, the first guiding section 91 and the second guiding section 92 are not moved with respect to the base portion 93, and the distance between the first guiding section 91 and the second guiding section 92 is constant. On the other hand, in the fifth embodiment, the distance between the first guiding section 71 and the second guiding section 72 ranges approximately from 44 mm to 105 mm.

A minimum width for guiding a medium P with the first guiding section 91 and the second guiding section 92 is approximately 44 mm. With this structure according to the modification, similarly to the fifth embodiment, the minimum width for guiding a medium P with the first guiding section 91 and the second guiding section 92 is narrower than the minimum width for guiding a medium P with the first edge guide 12*a* and the second edge guide 12*b*.

For example, with the first guiding section 91 and the second guiding section 92 that have a constant distance therebetween, while guiding a special size medium P, the distance between the first guiding section 91 and the second guiding section 92 does not change, and thus the width adjuster 90 of the medium feeding apparatus 10F can stably guide the special size medium P. The medium feeding apparatus 10F according to the modification provided with the width adjuster 90 can stably feed a special size medium P in the sheet feeding direction F. The scanner 1 including the medium feeding apparatus 10F according to the modification can stably read an image on a special size medium P.

8. Third Modification

The medium feeding apparatus 10D according to the fifth embodiment and the medium feeding apparatus 10F according to the second modification have the two medium feed slots, that is, the medium feed slot 6 defined by the edge guide 12 and the medium feed slot 77 in the width adjuster 70 and the width adjuster 90 respectively. The number of the medium feed slots in the medium feeding apparatuses is not limited to two, and two or more medium feed slots may be provided. That is, the width adjusters may be provided with at least one feed slot from which a medium is fed. For example, in the width adjuster 90 according to the second modification, a plurality of medium feed slots that have different minimum widths for guiding a medium P may be disposed in the Z direction.

9. Fourth Modification

The medium feeding apparatuses 10, 10A, 10B, 10C, 10D, 10E, and 10F according to the above-described embodiments or modifications may be applied not exclusively to the scanner 1. For example, in addition to the scanner, the medium feeding apparatus 10, 10A, 10B, 10C, 10D, 10E, or 10F according to the above-described embodiments or modifications may be applied to printing apparatuses or facsimile apparatuses, and to multifunction peripherals that have these functions.

Contents derived from the above-described embodiments will be described below.

A medium feeding apparatus includes a medium mounting section on which a medium is to be mounted, a movable edge guide configured to guide both edges of the medium mounted on the medium mounting section, the edge guide having a first edge guide and a second edge guide, a feeding section configured to feed the medium mounted on the medium mounting section, a width adjuster detachably attached to the edge guide, the width adjuster being configured to adjust a guide width depending on the medium. The width adjuster comprises a first adjuster having a first holding section and a first guiding section, and the second adjuster having a second holding section and a second guiding section, the first holding section holds a part of the first edge guide, the first guiding section guides the edge of the medium between the first edge guide and the second guiding section, the second holding section holds a part of the second edge guide, and the second guiding section guides the edge of the medium between the second edge guide and the first guiding section.

A width adjuster includes a first adjuster that is to be attached to a first edge guide and a second adjuster that is to be attached to a second edge guide. A first guiding section of the first adjuster guides an edge of a medium between the first edge guide and the second edge guide, and a second guiding section of the second adjuster guides an edge of the medium between the second edge guide and the first guiding section. With this structure, the width adjuster guides the edges of the medium between the first edge guide and the second edge guide, and thus the width adjuster can guide a special size medium that is narrower in width than a medium that can be guided by the edge guide. Accordingly, when a special size medium cannot be guided by the edge guide, by the use of the width adjuster attached to the edge guide, the special size medium can be guided by the width adjuster, and thus skew of the special size medium can be suppressed. Consequently, the medium feeding apparatus can properly feed the special size medium.

In the medium feeding apparatus, the medium mounting section may include a rotation member configured to facilitate the feeding of the medium, and the width adjuster may have a hole for exposing the rotation member when the width adjuster is attached to the edge guide.

When the width adjuster is attached to the edge guide, the rotation member configured to facilitate the feeding of the medium is exposed through the hole, and thereby a special size medium is fed while being supported by the rotation member. Accordingly, as compared with a case in which the special size medium is not supported by the rotation member, the special size medium can be smoothly fed.

In the medium feeding apparatus, the first adjuster and the second adjuster may be separate components.

The first adjuster and the second adjuster that are separate components allow a user to move the edge guide to adjust the distance between the first adjuster and the second adjuster. Accordingly, by the first adjuster and the second adjuster, special size media of various sizes can be guided.

In the medium feeding apparatus, the first guiding section may extend downstream longer in the sheet feeding direction than the first edge guide, and the second guiding section may extend downstream longer in the sheet feeding direction than the second edge guide.

In the first guiding section that extends downstream longer in the sheet feeding direction than the first edge guide and the second guiding section that extends downstream longer in the sheet feeding direction than the second edge guide, the portion for guiding a medium in the width adjuster is longer than the portion for guiding the medium in the edge guide. Accordingly, as compared with the edge guide, the width adjuster can properly feed a medium that is long in the sheet feeding direction.

A medium feeding apparatus includes a medium mounting section on which a medium is to be mounted, a movable edge guide configured to guide both edges of the medium mounted on the medium mounting section, the edge guide having a first edge guide and a second edge guide, a feeding section configured to feed the medium mounted on the medium mounting section, a width adjuster detachably attached to the medium mounting section, the width adjuster being configured to adjust a guide width depending on the medium. The width adjuster includes an engaging portion to be engaged with an engaged portion of the medium mounting section, a first guiding section configured to guide the edge of the medium at a position closer to a central portion in the medium mounting section than the first edge guide, and a second guiding section configured to guide the edge of the medium at a position closer to the central portion in the medium mounting section than the second edge guide.

A first guiding section of the width adjuster guides the edge of the medium at a position closer to a central portion in the medium mounting section than the first edge guide, and a second guiding section of the width adjuster guides the edge of the medium at a position closer to the central portion in the medium mounting section than the second edge guide, and thus the width adjuster can guide a special size medium that is narrower in width than a medium that can be guided by the edge guide. Accordingly, when a special size medium cannot be guided by the edge guide, by attaching the width adjuster to the medium mounting section by engaging the engaging portion with the engaged portion in the medium mounting section, the special size medium can be guided by the width adjuster, and thus skew of the special size medium can be suppressed. Consequently, the medium feeding apparatus can properly feed the special size medium.

In the medium feeding apparatus, the engaged portion may be a concave portion or a hole in the mounting surface of the medium mounting section.

When the engaged portion is a concave portion or a hole in the mounting surface of the medium mounting section, with an engaging portion (for example, a convex portion) that can engage with the concave portion or the hole provided in the width adjuster, the width adjuster can be attached to the medium mounting section.

In the medium feeding apparatus, the medium mounting section may further include a rotation member configured to facilitate the feeding of the medium, and the width adjuster may have a hole for exposing the rotation member when the width adjuster is attached to the medium mounting section.

When the width adjuster is attached to the medium mounting section, the rotation member configured to facilitate the feeding of the medium is exposed through the hole, and thereby a special size medium is fed while being supported by the rotation member. Accordingly, as compared with a case in which the special size medium is not supported by the rotation member, the special size medium can be smoothly fed.

A medium feeding apparatus includes a body, a medium mounting section on which a medium is to be mounted, a movable edge guide configured to guide both edges of the medium mounted on the medium mounting section, the edge guide having a first edge guide and a second edge guide, a feeding section configured to feed the medium mounted on the medium mounting section, and a width adjuster detachably attached to at least one of the body section, the medium mounting section, and the edge guide, the width adjuster being configured to adjust a guide width depending on the medium. The width adjuster includes a fixing section to be attached to at least one of the body section, the medium mounting section, and the edge guide, a first guiding section configured to guide the edge of the medium, and a second guiding section configured to guide the edge of the medium, and a minimum width for guiding the medium with the first guiding section and the second guiding section is narrower than a minimum width for guiding the medium with the first edge guide and the second edge guide.

A minimum width for guiding the medium with the first guiding section and the second guiding section is narrower than a minimum width for guiding the medium with the first edge guide and the second edge guide, and thus the width adjuster can guide a special size medium that is narrower in width than that can be guided by the edge guide. Accordingly, when a special size medium cannot be guided by the edge guide, by attaching the width adjuster to at least one of the body section, the medium mounting section, and the edge guide, the special size medium can be guided by the width adjuster, and thus skew of the special size medium can be suppressed. Consequently, the medium feeding apparatus can properly feed the special size medium.

In the medium feeding apparatus, at least one of the first guiding section and the second guiding section may be configured to move in the same direction as the first edge guide or the second edge guide.

When at least one of the first guiding section and the second guiding section is moved in the same direction as the first edge guide or the second edge guide, the distance between the first guiding section and the second guiding section can be adjusted. Accordingly, by the width adjuster, special size media of various sizes can be guided.

In the medium feeding apparatus, the width adjuster may have at least one feed slot from which the medium is fed.

By attaching the width adjuster that has a feed slot from which the medium is fed, in addition to the feed slot defined by the edge guide, the new feed slot in the width adjuster is provided to the medium feeding apparatus, and the medium feeding apparatus can properly feed a special size medium in addition to a medium of a common size.

What is claimed is:

1. A medium feeding apparatus comprising:

a medium mounting section on which a medium is to be mounted;

a movable edge guide configured to guide both edges of the medium mounted on the medium mounting section, the edge guide having a first edge guide and a second edge guide;

a feeding section configured to feed the medium mounted on the medium mounting section;

a rotation member configured to facilitate the feeding of the medium; and a width adjuster detachably attached to the edge guide, the width adjuster being configured to adjust a guide width depending on the medium, wherein the width adjuster comprises a first adjuster having a first holding section and a first guiding section, and a second adjuster having a second holding section and a second guiding section, and the width adjuster has a hole for exposing the rotation member when the width adjuster is attached to the edge guide, the first holding section holds a part of the first edge guide, the first guiding section guides the edge of the medium between the first edge guide and the second guiding section, the second holding section holds a part of the second edge guide, and the second guiding section guides the edge of the medium between the second edge guide and the first guiding section.

2. The medium feeding apparatus according to claim 1, wherein the first adjuster and the second adjuster are separate components.

3. The medium feeding apparatus according to claim 1, wherein the first guiding section extends downstream longer in the sheet feeding direction than the first edge guide, and the second guiding section extends downstream longer in the sheet feeding direction than the second edge guide.

4. A medium feeding apparatus comprising:

a medium mounting section on which a medium is to be mounted;

a movable edge guide configured to guide both edges of the medium mounted on the medium mounting section, the edge guide having a first edge guide and a second edge guide;

a feeding section configured to feed the medium mounted on the medium mounting section;

a rotation member configured to facilitate the feeding of the medium; and a width adjuster detachably attached to the medium mounting section, the width adjuster being configured to adjust a guide width depending on the medium, and width adjuster has a hole for exposing the rotation member when the width adjuster is attached to the edge guide, wherein the width adjuster comprises an engaging portion to be engaged with an engaged portion of the medium mounting section;

a first guiding section configured to guide the edge of the medium at a position closer to a central portion in the medium mounting section than the first edge guide; and a second guiding section configured to guide the edge of the medium at a position closer to the central portion in the medium mounting section than the second edge guide.

5. The medium feeding apparatus according to claim 4, wherein the engaged portion is a concave portion or a hole in the mounting surface of the medium mounting section.

6. A medium feeding apparatus comprising:

a body section;

a medium mounting section on which a medium is to be mounted;

a movable edge guide configured to guide both edges of the medium mounted on the medium mounting section, the edge guide having a first edge guide and a second edge guide;

a feeding section configured to feed the medium mounted on the medium mounting section; and a width adjuster detachably attached to at least one of the body section, the medium mounting section, and the edge guide, the width adjuster being configured to adjust a guide width depending on the medium and wherein the width adjuster has at least one feed slot from which the medium is fed, wherein the width adjuster comprises a fixing section to be attached to at least one of the body section, the medium mounting section, and the edge guide;

a first guiding section configured to guide the edge of the medium; and a second guiding section configured to guide the edge of the medium, and a minimum width for guiding the medium with the first guiding section and the second guiding section is narrower than a minimum width for guiding the medium with the first edge guide and the second edge guide.

7. The medium feeding apparatus according to claim 6, wherein at least one of the first guiding section and the second guiding section is configured to move in the same direction as the first edge guide or the second edge guide.

* * * * *